US009077096B2

(12) United States Patent
Simmel et al.

(10) Patent No.: US 9,077,096 B2
(45) Date of Patent: Jul. 7, 2015

(54) CONNECTOR RECEPTACLE SHELL THAT FORMS A GROUND CONTACT

(75) Inventors: George Marc Simmel, Cupertino, CA (US); Zheng Gao, San Jose, CA (US)

(73) Assignee: Apple Inc., Cupertino, CA (US)

( * ) Notice: Subject to any disclaimer, the term of this patent is extended or adjusted under 35 U.S.C. 154(b) by 149 days.

(21) Appl. No.: 13/492,908

(22) Filed: Jun. 10, 2012

(65) Prior Publication Data

US 2013/0288520 A1 Oct. 31, 2013

Related U.S. Application Data

(63) Continuation-in-part of application No. 13/457,476, filed on Apr. 26, 2012.

(51) Int. Cl.

| | |
|---|---|
| ***H01R 13/648*** | (2006.01) |
| ***H01R 13/502*** | (2006.01) |
| ***H01R 13/6583*** | (2011.01) |
| *H01R 13/627* | (2006.01) |
| *H01R 24/62* | (2011.01) |

(52) U.S. Cl.

CPC ..... *H01R 13/502* (2013.01); *H01R 13/6275* (2013.01); *H01R 13/6583* (2013.01); *H01R 24/62* (2013.01); *Y10T 29/49004* (2015.01)

(58) Field of Classification Search

USPC ..... 439/607.04–607.59

See application file for complete search history.

(56) References Cited

U.S. PATENT DOCUMENTS

| | | | | |
|---|---|---|---|---|
| 4,365,856 | A * | 12/1982 | Yaegashi et al. | 439/497 |
| 4,386,814 | A * | 6/1983 | Asick | 439/607.28 |
| 6,010,365 | A * | 1/2000 | Wu et al. | 439/607.02 |
| 7,344,409 | B2 | 3/2008 | Lang et al. | |
| 7,563,140 | B1 * | 7/2009 | Wan et al. | 439/660 |
| 7,614,920 | B1 | 11/2009 | Yi | |
| 7,618,268 | B2 * | 11/2009 | Ko et al. | 439/101 |
| 7,625,243 | B2 * | 12/2009 | Chen et al. | 439/660 |
| 7,670,156 | B2 * | 3/2010 | Chen | 439/108 |
| 7,699,663 | B1 * | 4/2010 | Little et al. | 439/660 |
| 2006/0234553 | A1 | 10/2006 | Tsai | |
| 2009/0163071 | A1 | 6/2009 | Chen | |

(Continued)

FOREIGN PATENT DOCUMENTS

EP 2 169 774 A1 3/2010

OTHER PUBLICATIONS

Invitation to Pay Additional Fees mailed on Jun. 14, 2013 for PCT Patent Application No. PCT/US2013/036655, 5 pages.

(Continued)

*Primary Examiner* — Vanessa Girardi

(74) *Attorney, Agent, or Firm* — Kilpatrick Townsend & Stockton LLP

(57) ABSTRACT

Connector receptacles that are simple to assemble, provide a good ground contact path, avoid marring of both inserts and receptacles, and can be arranged to fit in a device enclosure. These receptacles may include a subassembly that is inserted into a hollow tongue. The subassembly may include a first number of contacts that are insert molded in a housing, as well as a second number of contacts. The tongue may further include ground contacts on its sides and top. The tongue may cover edges of at least some contacts to prevent marring of both the connector receptacle and connector insert. The shell of the connector receptacle may be formed around a portion of the connector receptacle to assist in fitting the receptacle in a device enclosure.

36 Claims, 24 Drawing Sheets

(56) References Cited

U.S. PATENT DOCUMENTS

| | | | | |
|---|---|---|---|---|
| 2010/0055986 | A1 | 3/2010 | Wang et al. | |
| 2010/0093215 | A1* | 4/2010 | Xiong et al. | 439/607.19 |
| 2010/0255727 | A1* | 10/2010 | He et al. | 439/607.3 |
| 2011/0237134 | A1 | 9/2011 | Gao et al. | |
| 2011/0250488 | A1* | 10/2011 | Park | 429/163 |
| 2011/0268396 | A1 | 11/2011 | He et al. | |

OTHER PUBLICATIONS

Non-Final Office Action mailed on Nov. 27, 2013 for U.S. Appl. No. 13/457,476, 10 pages.

International Search Report and Written Opinion mailed on Oct. 10, 2013 for PCT Patent Application No. PCT/US2013/036655, 19 pages.

Australian Office Action mailed on Jul. 25, 2014 for AU Patent Application No. 2013205683, 4 pages.

Final Office Action mailed on Aug. 6, 2014 for U.S. Appl. No. 13/457,476, 12 pages.

Non-Final Office Action mailed on Dec. 29, 2014 for U.S. Appl. No. 13/457,476, 11 pages.

* cited by examiner

CONNECTOR RECEPTACLE SHELL THAT FORMS A GROUND CONTACT

CROSS-REFERENCES TO RELATED APPLICATIONS

This application is a continuation-in-part of U.S. patent application Ser. No. 13/457,476, filed Apr. 26, 2012, which is incorporated by reference.

BACKGROUND

The number and types of electronic devices available to consumers have increased tremendously the past few years, and this increase shows no signs of abating. Devices such as portable computing devices, tablet, desktop, and all-in-one computers, cell, smart, and media phones, storage devices, portable media players, navigation systems, monitors and other devices have become ubiquitous.

These devices often receive and provide power and data using various cable assemblies. These cable assemblies may include connector inserts, or plugs, on one or more ends of a cable. The connector inserts may plug into connector receptacles on electronic devices, thereby forming one or more conductive paths for signals and power.

The connector receptacles may be formed of housings that typically at least partially surround, and provide mechanical support for, a number of contacts. These contacts may be arranged to mate with corresponding contacts on the connector inserts or plugs to form portions of electrical paths between devices.

The numbers of these receptacles that are manufactured for some electronic devices can be very large. Accordingly, it may be desirable to provide connector receptacles that are simple to assemble and manufacture.

As a further complication, the data rates of some signals conveyed by these connector receptacles have increased over time. To be able to handle these signals, it may be desirable that the connector receptacles do not degrade signal quality significantly. An important aspect of providing good signal quality is to provide a good ground path and shielding for the connector receptacle and corresponding connector insert. Accordingly, it may be desirable to provide connector receptacles that provide a good ground path. It may also be desirable to provide connector receptacles that may avoid marring during use, and are arranged to fit in a device enclosure.

Thus, what is needed are connector receptacles that are simple to assemble, provide a good ground contact path, avoid marring of both inserts and receptacles, and can be arranged to fit in a device enclosure.

SUMMARY

Accordingly, embodiments of the present invention may provide connector receptacles that are simple to assemble, provide a good ground contact path, avoid marring of both inserts and receptacles, and can be arranged to fit in a device enclosure.

An illustrative embodiment of the present invention may simplify assembly by providing a connector receptacle having a number of contacts in a subassembly. The subassembly may include a first number of contacts that are insert-molded in a subassembly housing. A second number of contacts may be added to the subassembly. The subassembly may be inserted into a hollow tongue portion of the connector receptacle. The hollow tongue may protect portions of the first and second numbers of contacts.

Another illustrative embodiment of the present invention may improve signal quality by providing a connector receptacle having a good ground connection. In various embodiments of the present invention, ground contacts may be located on a tongue of the connector receptacle. In a specific embodiment of the present invention, ground contacts may be located on sides of a tongue. Various numbers of contacts may be further included on a top of the tongue as well.

Another illustrative embodiment of the present invention may provide a connector receptacle that avoids marring of both the connector receptacle and connector insert. A specific embodiment of the present invention accomplishes this by inert molding at least some contacts such that no sharp edges are exposed or come into contact with a connector insert during insertion.

Another illustrative embodiment of the present invention may provide a connector receptacle that is arranged to fit in a device enclosure. In a specific embodiment of the present invention, a shell may be formed around a portion of a connector receptacle, such as the sides and bottom, while being substantially absent from its top. In this embodiment, a partial top piece may be included. The partial top piece may be connected to the shell and include fingers for contacting a portion of a device enclosure.

Embodiments of the present invention may be used to improve various connector receptacles, such as those compatible with the various Universal Serial Bus interfaces and standards, including USB, USB2, and USB3, as well as High-Definition Multimedia Interface (HDMI), Digital Visual Interface (DVI), power, Ethernet, DisplayPort, Thunderbolt, and other types of interfaces and standards. These connector receptacles may be utilized in many types of devices, such as portable computing devices, tablet, desktop, and all-in-one computers, cell, smart, and media phones, storage devices, portable media players, navigation systems, monitors and other devices.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
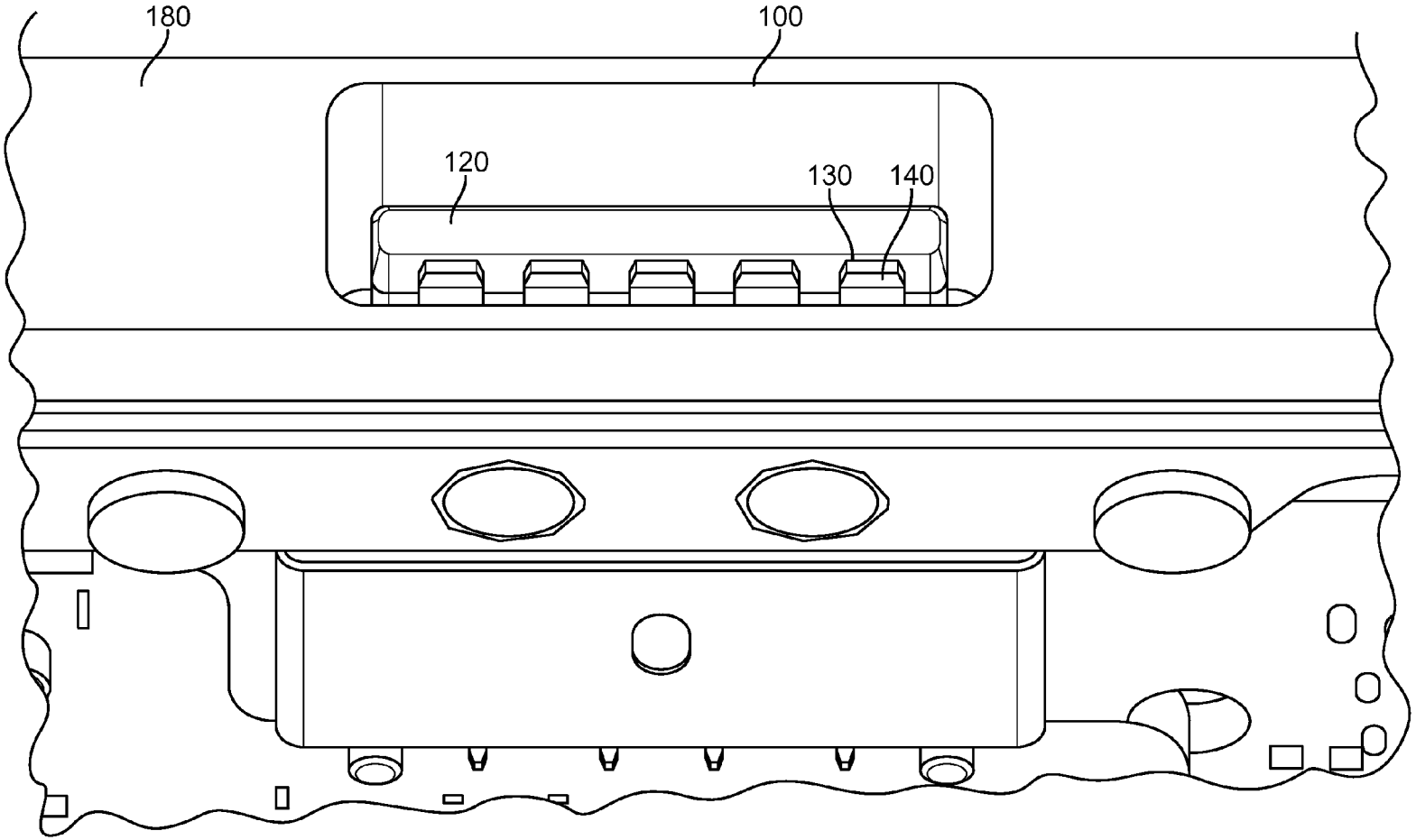
FIG. 1 illustrates a portion of an electronic system according to an embodiment of the present invention.

FIG. 1 illustrates a portion of an electronic system according to an embodiment of the present invention. This figure, as with the other included figures, is shown for illustrative purposes and does not limit either the possible embodiments of the present invention or the claims.

This figure shows a portion of an electronic device having connector receptacle 100 located in device housing 180. Connector receptacle 100 may include tongue 120 having openings 130 for a first number of contacts 140. Tongue 120 may further include other openings for other contacts, including ground contacts that are not shown in this figure.

Again, it may be desirable that connector receptacle 100 does not become marred after repeated insertions of a connector insert. Also, may be desirable that connector receptacle 100 does not mar the connector insert. Accordingly, connector receptacle 100 may include tongue 120 that is configured to not become marred, and to not mar a connector insert. For example, openings 130 in tongue 120 may be such that edges of the first number of contacts 140 are not exposed. This prevents the first number of contacts 140 from marring a connector insert, or from getting caught, or snagged by, and damaged by a connector insert.

Device housing 180 may be representative of many types of devices, such as portable computing devices, tablet, desktop, and all-in-one computers, cell, smart, and media phones, storage devices, portable media players, navigation systems, monitors and other devices.

To improve signal quality in connector receptacle 100, it may be desirable that connector receptacle 100 include robust ground paths. Accordingly, embodiments of the present invention may provide a connector receptacle having ground contacts in tongue 120. An example is shown in the following figure.

Figure 2:
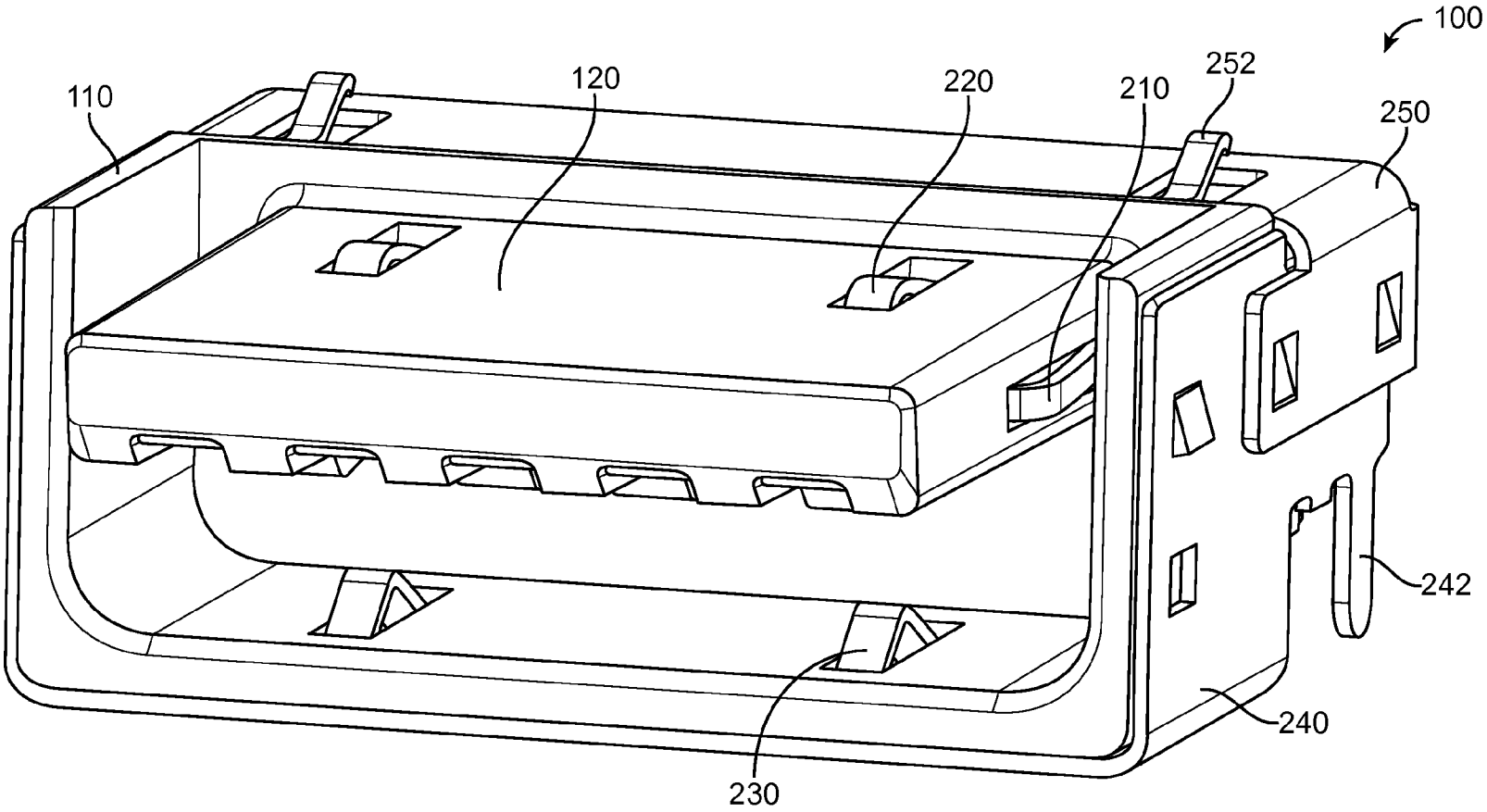
FIG. 2 illustrates an oblique front view of a connector receptacle according to an embodiment of the present invention.

FIG. 2 illustrates an oblique front view of a connector receptacle according to an embodiment of the present invention. Connector receptacle 100 may include receptacle housing 100, which may in turn include tongue 120. Tongue 120 may have two side openings for side ground contacts 210, and two top openings for top ground contacts 220. In other embodiments of the present invention, other numbers of contacts, and contacts in other positions, may be utilized. Connector receptacle 100 may further include ground contacts 230 in a bottom of receptacle housing 110. These various ground contacts may provide ground paths as well as retention features, that is, features that may hold a connector insert in place, for connector receptacle 100.

Again, it may be desirable that connector receptacles be configured to fit in specific device enclosures. It may also be desirable to provide an aesthetically pleasing appearance to a user. Accordingly, embodiments of the present invention may provide a connector receptacle having a housing that does not substantially have a top portion. Instead, the top portion of the connector receptacle may be formed by a portion of the device enclosure. This arrangement may also provide an aesthetically pleasing appearance.

Accordingly, housing 110 of connector receptacle 100 has sides, a bottom, and a back, but does not substantially have a top. Similarly, shell 240 covers connector receptacle 100 along its bottom, rear, and sides, but does not cover its top. Top piece 250 may be included along a back portion of the top and electrically connected to shell 240. Top piece 250 may include one or more fingers 252 for electrically contacting a device enclosure, or other structure inside the device enclosure. Shield 240 may include one or more tabs 242, which may be soldered, or otherwise fixed or connected to, a flexible circuit board, printed circuit board, or other appropriate substrate.

Figure 3:
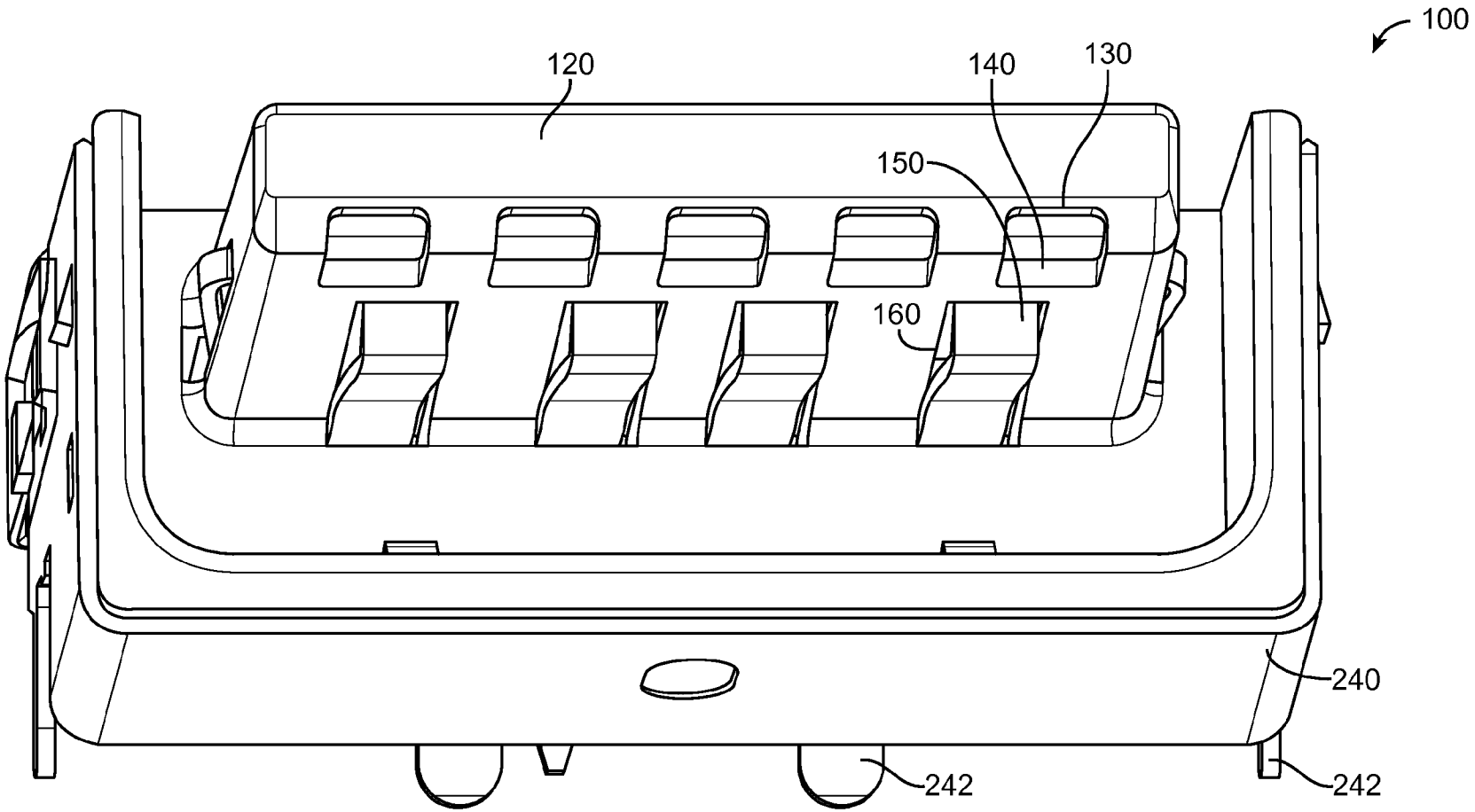
FIG. 3 illustrates another front oblique view of a connector receptacle according to an embodiment of the present invention.

FIG. 3 illustrates another front oblique view of a connector receptacle according to an embodiment of the present invention. As before, tongue 120 may include openings 130 for a first number of contacts 140. Tongue 120 may further include a second number of openings 160 for a second number of contacts 150. In this example, the first number of contacts 140 may be between the second number of contacts 150 and a front of tongue 120. As before, shield 240 may include a number of tabs 242, which may be soldered or otherwise electrically connected to a flexible circuit board, printed circuit board, or other appropriate substrate.

In this specific example, connector receptacle 100 may be a USB3 compatible connector receptacle. In other embodiments of the present invention, other types of connector receptacles may be improved by the incorporation of embodiments of the present invention. These may include the other USB standards, as well as High-Definition Multimedia Interface (HDMI), Digital Visual Interface (DVI), power, Ethernet, DisplayPort, Thunderbolt, and other types of interfaces and standards.

Also in this example, a first a number of contacts 140 may be contacts added for USB3 compatibility, while a second number of contacts 160 may be legacy USB contacts.

Figure 4:
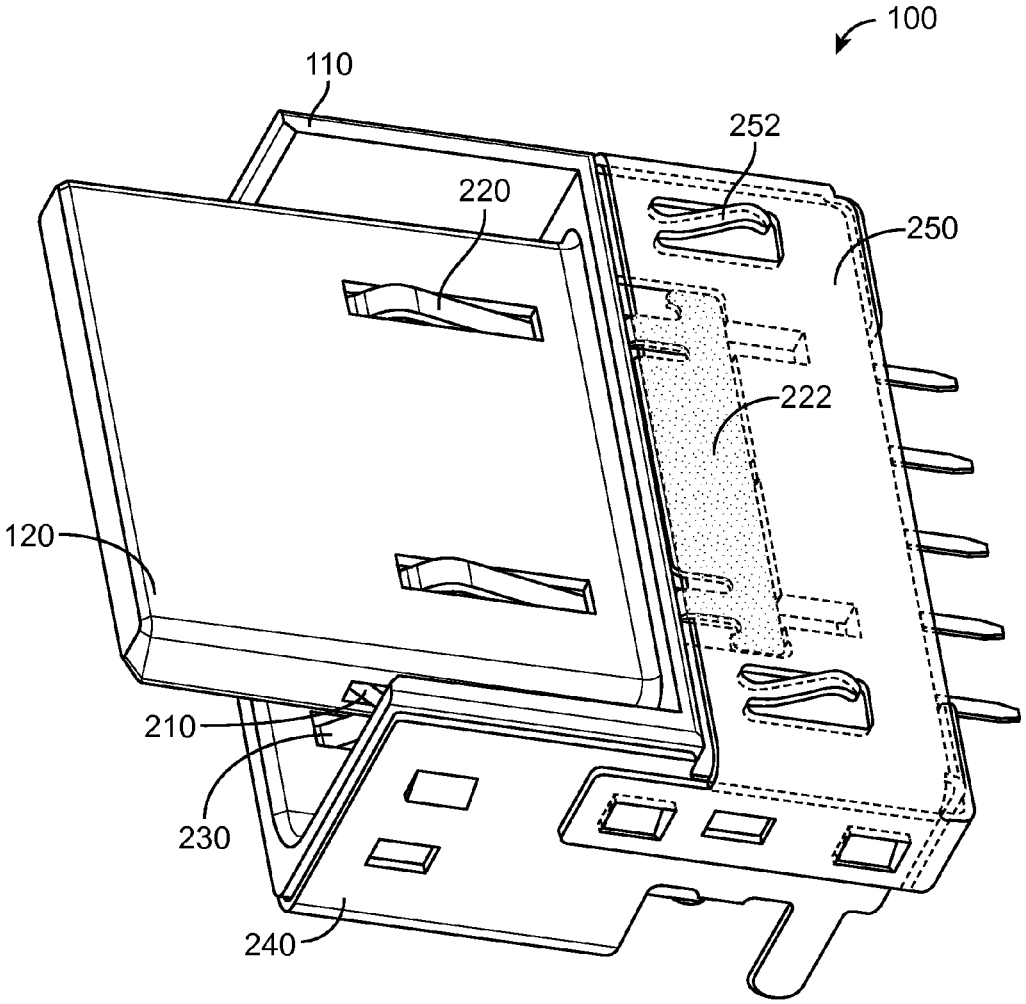
FIG. 4 illustrates a top oblique view of a connector receptacle according to an embodiment of the present invention.

FIG. 4 illustrates a top oblique view of a connector receptacle according to an embodiment of the present invention. Again, tongue 120 may include one or more openings on its sides for ground contacts 210, and openings in its top for ground contacts 220. Contacts 220 may be connected by crosspiece 222. Crosspiece 222 may be grounded by being spot or laser welded to top piece 250.

Housing 110 may include openings along its bottom for ground contacts 230. Shield 240 may surround connector receptacle 100 along its bottom and sides. Top piece 250 may include fingers 252, which may contact a device enclosure, or other structure inside, or otherwise associated with, a device enclosure.

Again, during the production of a popular device, many of these connector receptacles may be manufactured. Accordingly, it may be desirable that connector receptacles according to embodiments of the present invention be readily manufactured, that is, it may be desirable that they are easily assembled. Accordingly, embodiments of the present invention may provide connector receptacles that include a subassembly that may be inserted into hollow tongue 120. An example of such a subassembly is shown in the following figure.

Figure 5:
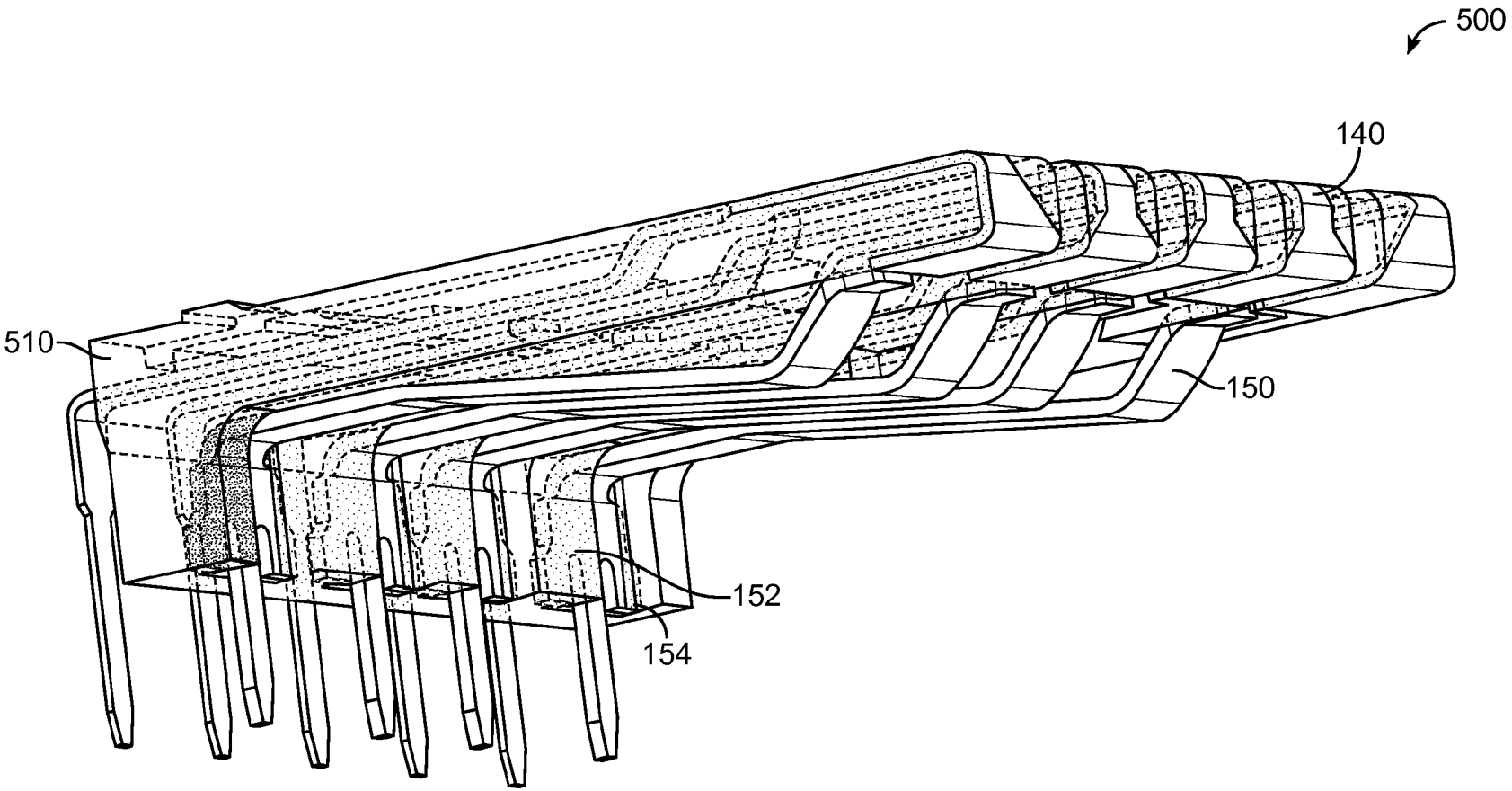
FIG. 5 illustrates a subassembly for a connector receptacle according to an embodiment of the present invention.

FIG. 5 illustrates a subassembly for a connector receptacle according to an embodiment of the present invention. This subassembly may include a first number of contacts 140 and a second number of contacts 150 joined together by housing 510. In a specific embodiment of the present invention, a first number of contacts 140 are insert molded into housing 510. That is, first contacts 140 are held in place, and housing 510 is formed around portions of these contacts. Second contacts 150 are then inserted into housing 510. For example, portions 152 of contacts 150 may be pushed into housing 510. Once in place, flanges 154 may expand and hold contacts 150 in place in housing 510.

Figure 6:
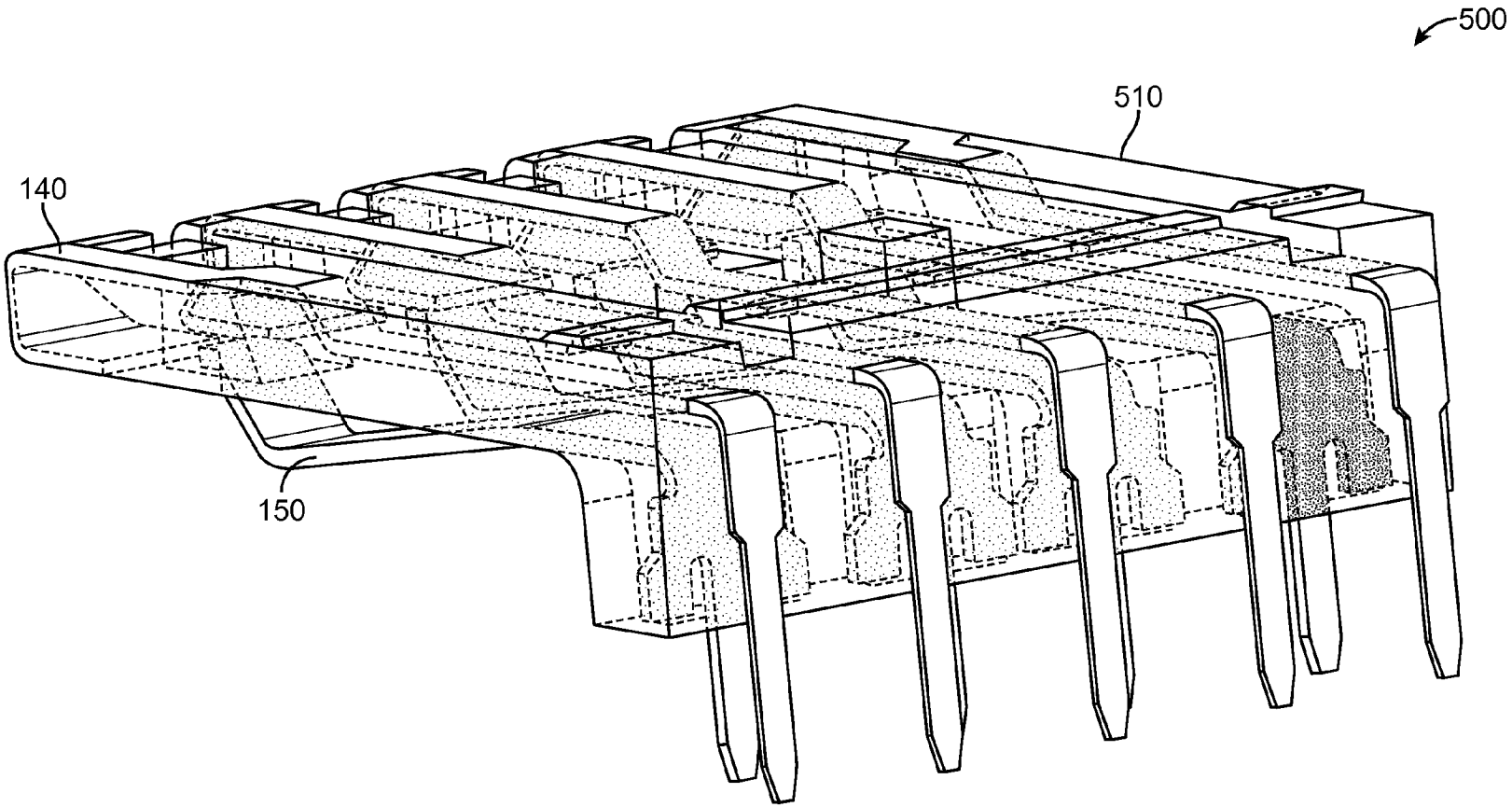
FIG. 6 illustrates a rear view of a subassembly for a connector receptacle according to embodiments of the present invention.

FIG. 6 illustrates a rear view of a subassembly for a connector receptacle according to embodiments of the present invention. Again, this subassembly may include a first number of contacts 140 and a second number of contacts 150 that are held together by housing 510.

During assembly, subassembly 500 may be inserted into a back of housing 110. This may allow subassembly 500 to slide into location inside of hollow tongue 120 in housing 110.

Figure 7:
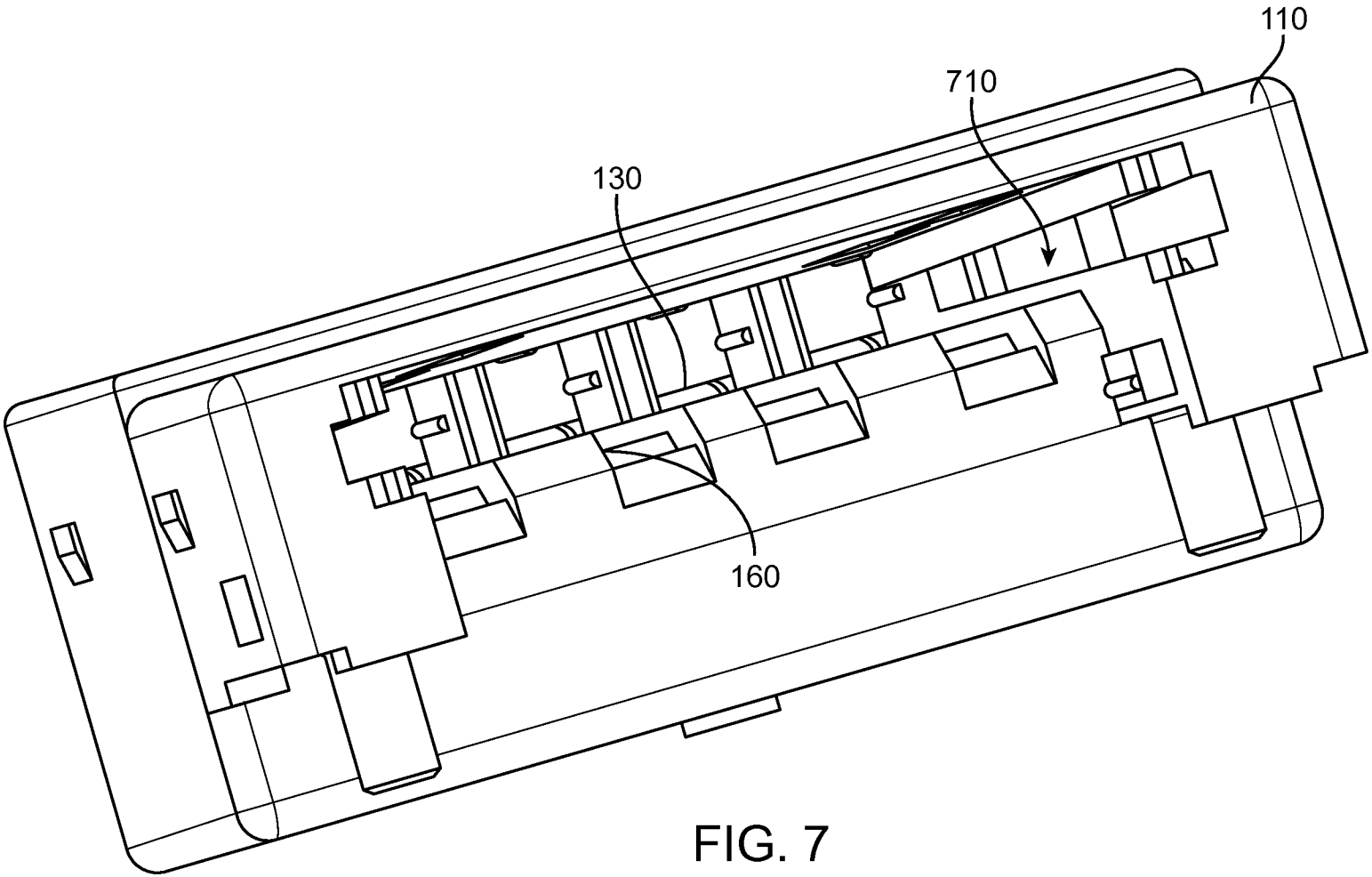
FIG. 7 illustrates a rear view of a connector receptacle housing according to an embodiment of the present invention.

FIG. 7 illustrates a rear view of a connector receptacle housing according to an embodiment of the present invention. Housing 110 may include a rear opening 710. This opening may allow access to the inside of the hollow tongue 120. Openings 130 and 160 in hollow tongue 120 may provide access to the first number of contacts and second number of contacts, respectively.

Figure 8:
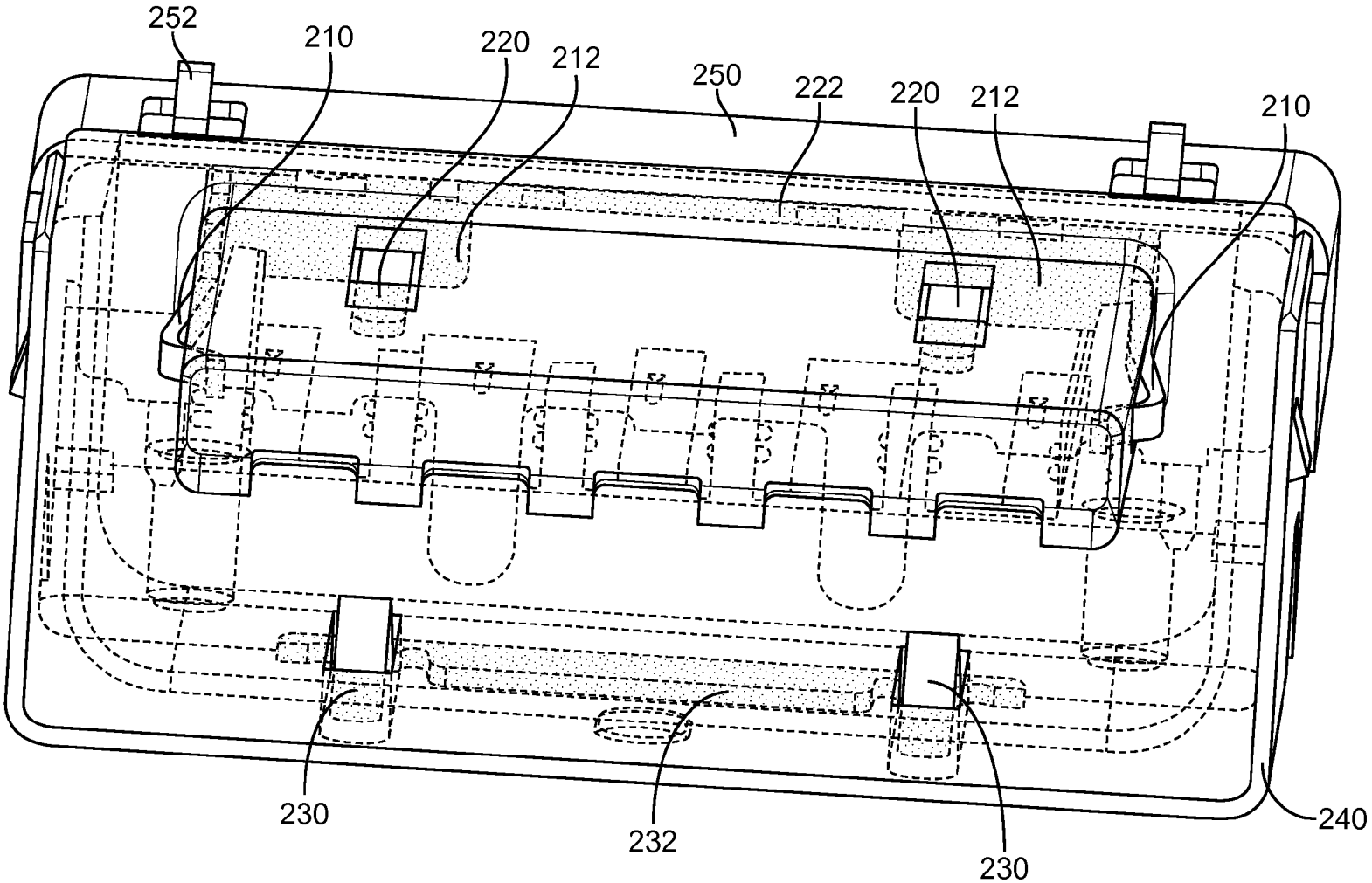
FIG. 8 illustrates a cutaway view of a connector receptacle according to an embodiment of the present invention.

FIG. 8 illustrates a cutaway view of a connector receptacle according to an embodiment of the present invention. Side contact 210 may connect to a rear of shell 240 via portion 212. Top contacts 220 may be joined via piece 222 as a single unit. Piece 222, may be, as was shown in FIG. 4, spot or laser welded to top piece 250. Ground contacts 230 may be joined by piece 232. Piece 232 may be laser or spot welded to shield 240. Shield 240 may include tabs 242, which again may electrically connect to ground connections in a flexible circuit board, printed circuit board, or other appropriate substrate. Shield 240 may electrically connect to top piece 250. Top piece 252 may include fingers 252 which form electrical connections with a device enclosure, or other structure is inside the device enclosure.

Figure 9:
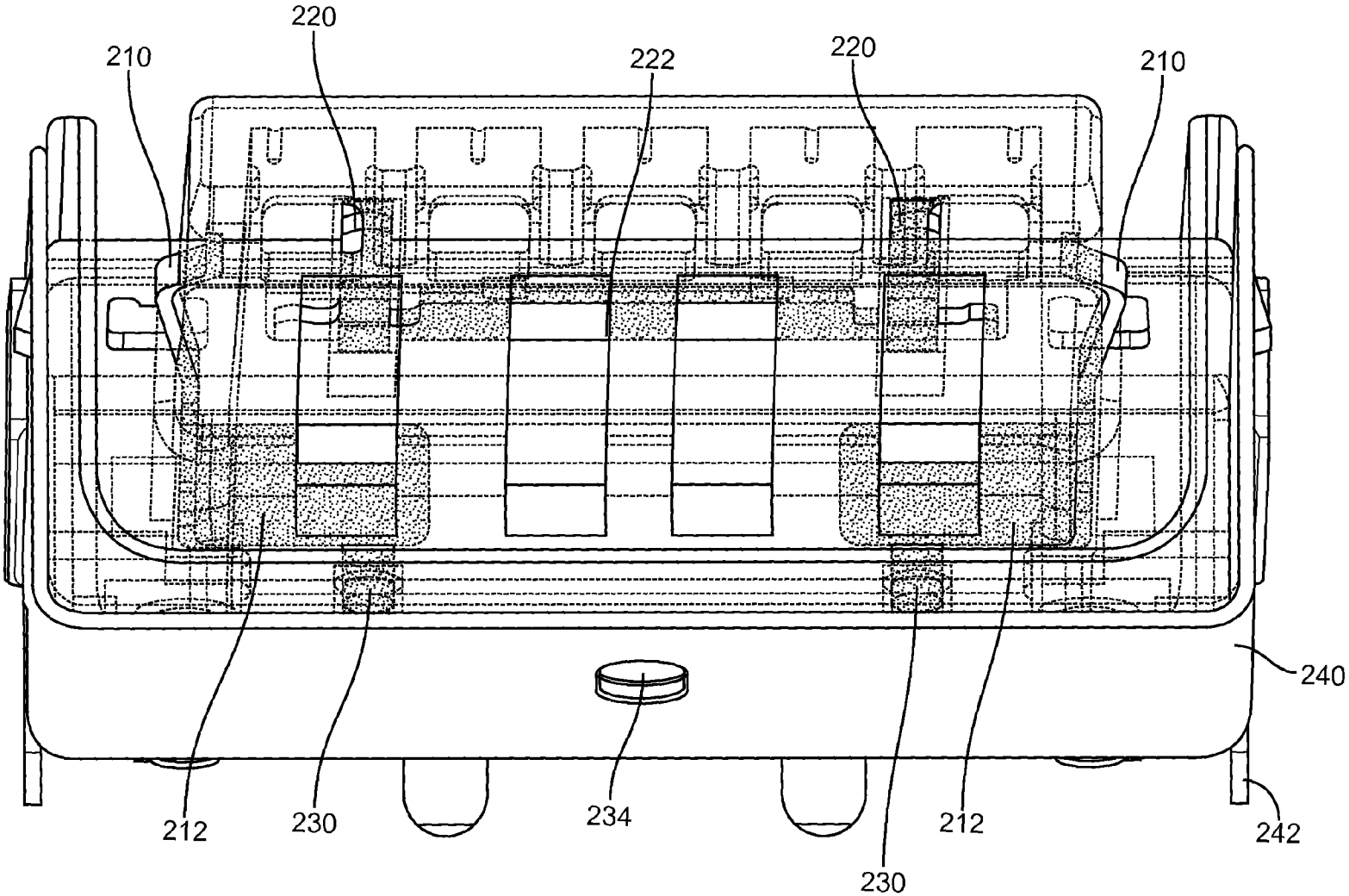
FIG. 9 illustrates another cutaway view of a connector receptacle according to an embodiment of the present invention.

FIG. 9 illustrates another cutaway view of a connector receptacle according to an embodiment of the present invention. As before, side contacts 210 may connect to a rear of shield 240 via portion 212. Top ground contacts 220 may join together though piece 222, which may electrically connect to top piece 250. Bottom ground contacts 230 may join together via piece 232 and be laser or spot welded to shell 240 at point 234. Top piece 250 may electrically connect to shell 240. Shield 240 may be grounded through tabs 242. Top piece 250 may be grounded through fingers 252.

Again, embodiments of the present invention may provide connector receptacles having good ground connections to improve signal quality. Another example is shown in the following figure.

Figure 10:
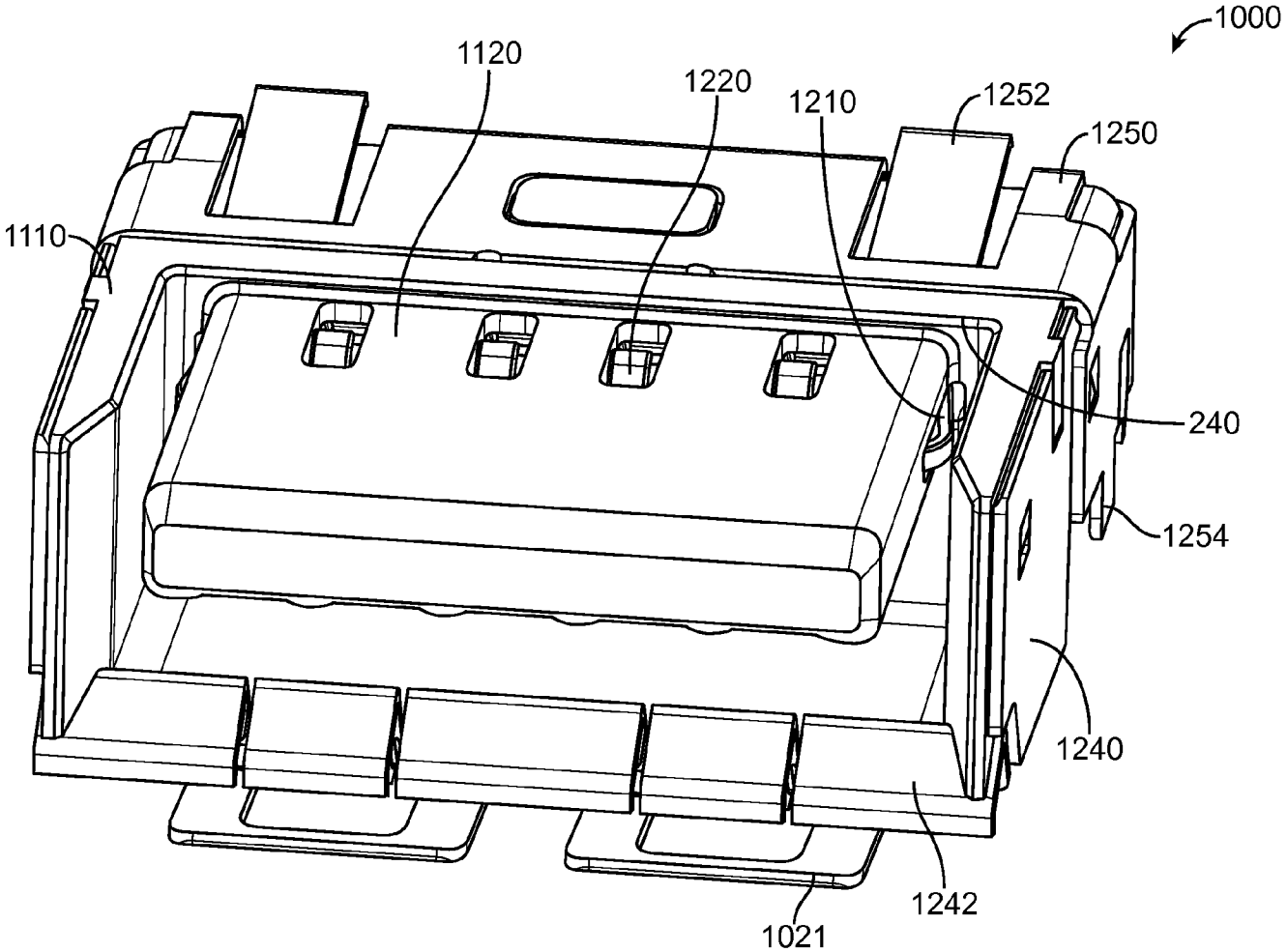
FIG. 10 illustrates another connector receptacle according to an embodiment of the present invention.

FIG. 10 illustrates another connector receptacle according to an embodiment of the present invention. Connector receptacle 1000 may include housing 1110 having tongue 1120. Side ground contacts 1210 and top contacts 1220 may be used to form ground connections. In this specific example, four top contacts 1220 are shown, though in other embodiments of the present invention, other numbers of top contacts may be used. Top contacts 1220 and side contacts 1210 may provide ground paths, as well as retention force to keep a connector insert in place when it is inserted into connector receptacle 1000.

As before, connector receptacle 1000 may be arranged to fit in a device enclosure. In a specific embodiment of the present invention, the device enclosure may be relatively thin. For this reason, it may be desirable to make connector receptacle 1000 correspondingly thin. Accordingly, connector receptacle 1000 may include housing 1110 that may form sides and a bottom of connector receptacle 1000, while connector receptacle 1000 may be substantially without a top. Shield 1240 may similarly be located on sides and a bottom of connector receptacle 1000. Bottom side contacts 1242 may contact a shell of a connector insert when is inserted into connector receptacle 1000. Bottom piece contacts 1021 may be used for mechanical support and to contact a device enclosure, printed circuit board, flexible circuit board, or other appropriate substrate. This connection may also be grounded. Top piece 1250 may cover a portion of a top of connector receptacle 1000. Top piece 1250 may include fingers 1252 and tabs 1254. Fingers 1252 may contact a device enclosure or other structure associated with device enclosure. In other embodiments, Fingers 1252 may contact other structures that may or may not be associated or connected to the device enclosure. Tabs 1254 may be used for mechanical support, and may connect to grounds in a flexible circuit board, printed circuit board, or other appropriate substrate.

Accordingly, connector receptacle may be well supported mechanically and well grounded. Again, fingers 1252 may contact a device enclosure, or structure associated or not associated or connected to the device enclosure. Bottom piece contacts 1021 may contact a device enclosure, flexible circuit board, or printed circuit board. These physical connections on the top and bottom of connector receptacle 1000 may ensure that connector receptacle 1000 is mechanically secure in the device housing. Also, either or both of these contacts may be grounded to improve signal quality.

Figure 11:
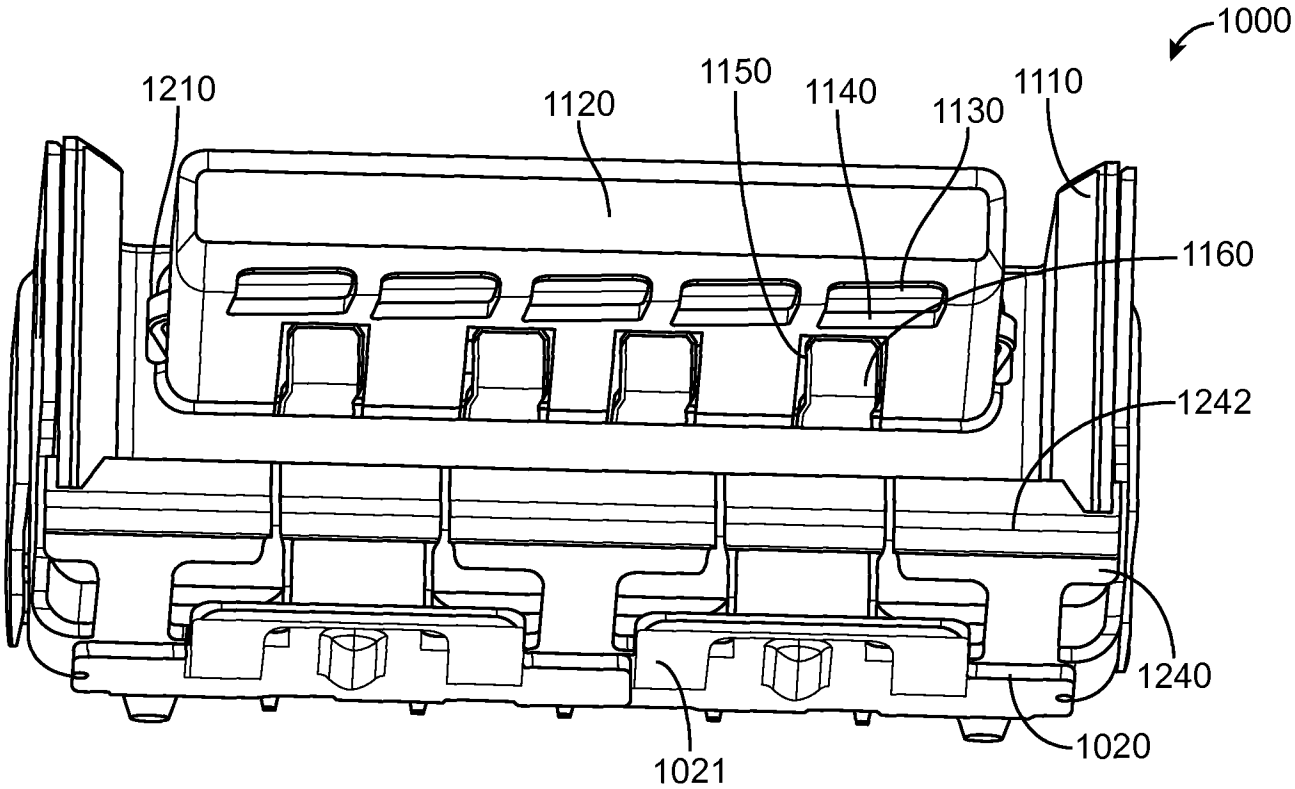
FIG. 11 illustrates an underside view of the connector receptacle of FIG. 10.

FIG. 11 illustrates an underside view of the connector receptacle of FIG. 10. Connector receptacle 1000 may include tongue 1120 and housing 1110. Tongue 1120 may include openings 1130 and 1150 for contacts 1140 and 1160, respectively. Shield 1240 may include bottom side contacts 1242. Bottom piece 1020 may be attached to shell 1240. Bottom piece 1020 may include bottom piece contacts 1021.

As can be seen, this embodiment of the present invention provides excellent grounding. Specifically, side ground contacts 1210 and top ground contacts 1220 on tongue 1120 may contact an inside of a shell of a connector insert when it is inserted into connector receptacle 1000. Bottom contacts 1242 may contact an outside of the connector insert shell. Bottom piece contacts 1021, fingers 1252, and tabs 1254, may be connected to ground on a device enclosure, flexible circuit board, printed circuit board, or other appropriate substrates.

Again, embodiments of the present invention may simplify assembly by providing a subassembly that may be inserted into a hollow tongue. An example of such a subassembly is shown in the following figures.

Figure 12:
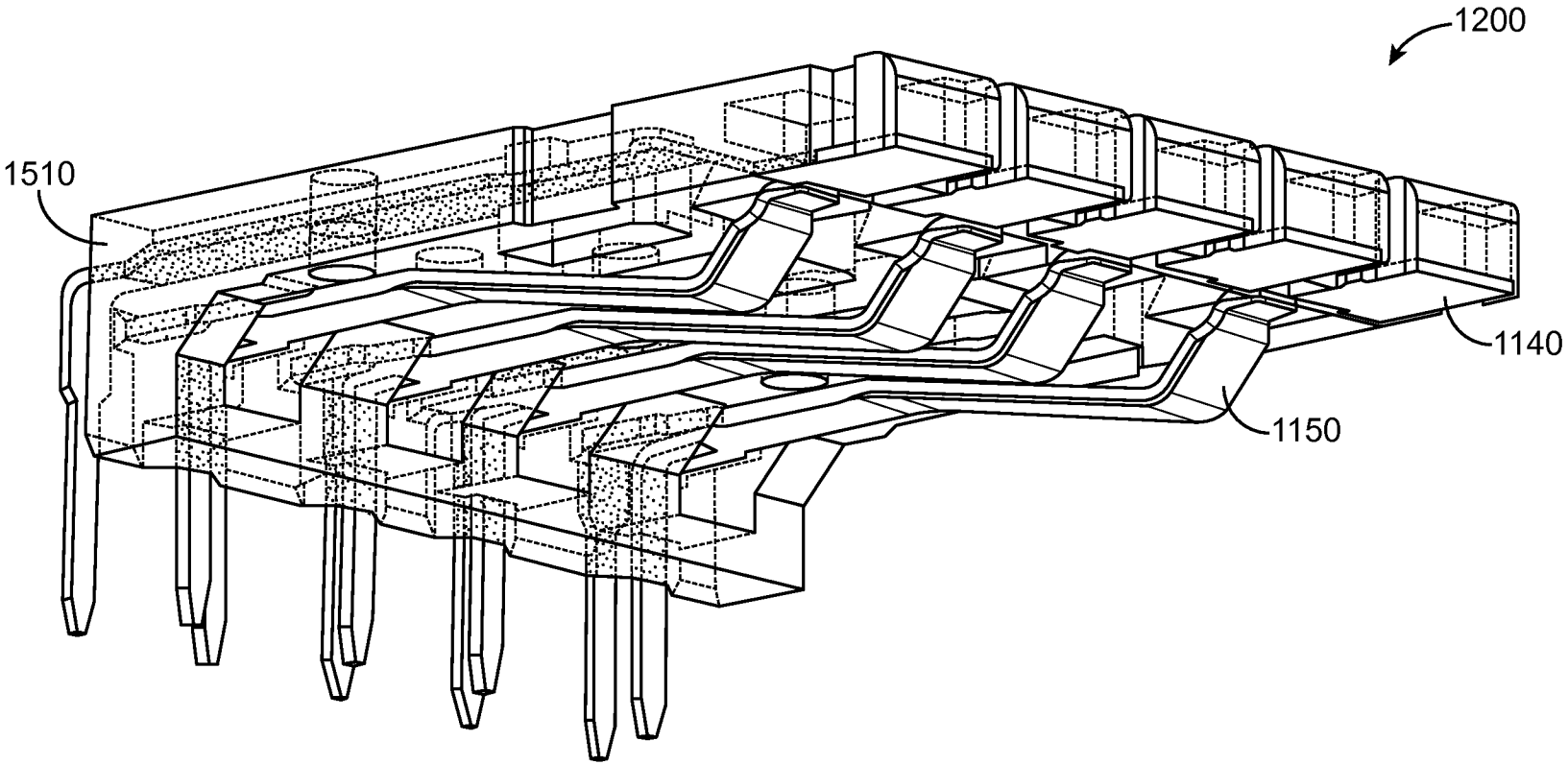
FIG. 12 illustrates a subassembly according to an embodiment of the present invention.

FIG. 12 illustrates a subassembly according to an embodiment of the present invention. This subassembly may include housing 1510. Housing 1510 may provide support for a first number of contacts 1140, and a second number of contacts 1150.

Figure 13:
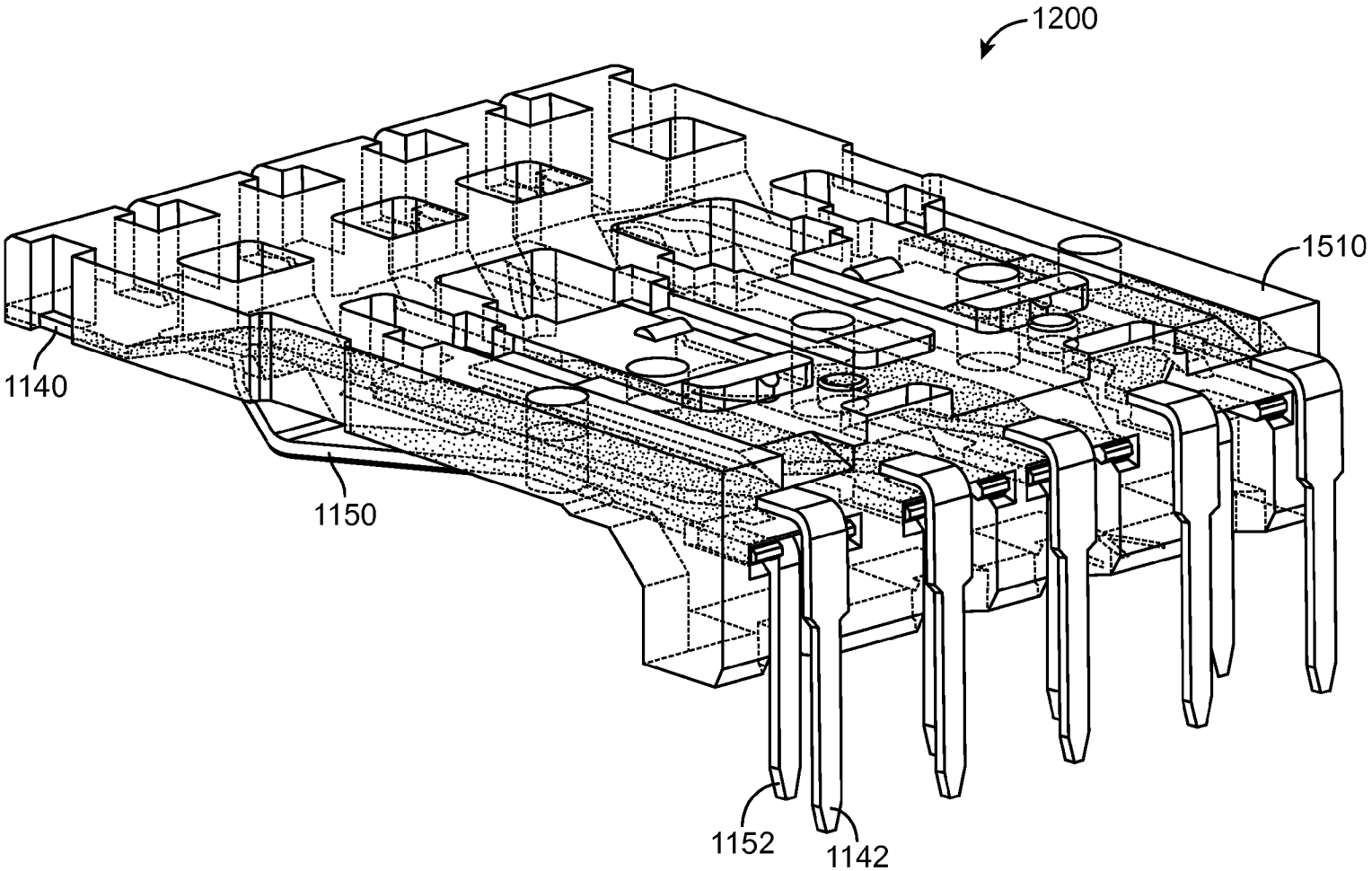
FIG. 13 illustrates another view of the subassembly of FIG. 12.

FIG. 13 illustrates another view of the subassembly of FIG. 12. Again, housing 1510 may provide support for a first a number of contacts 1140 and a second number of contacts 1150. The first number of contacts 1140 may have first through-hole contacting portions 1142, while the second number of contacts 1150 may have second through-hole contacting portions 1152.

Again, embodiments of the present invention may provide a connector that may be relatively simple to assemble. An example of the assembly one such connector is shown in the following figures.

Figure 14:
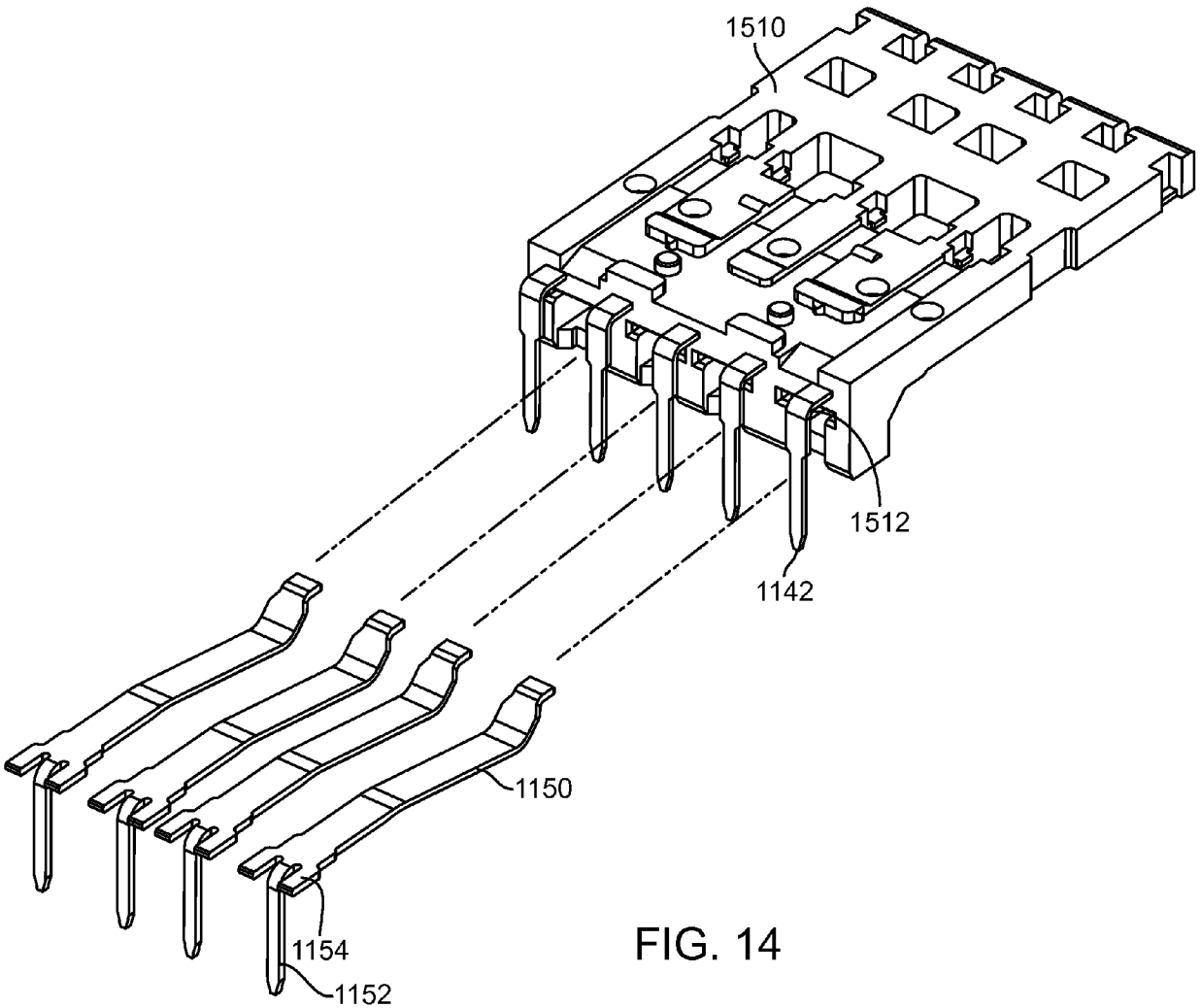
FIG. 14 illustrates an assembly of a subassembly according to an embodiment of the present invention.

FIG. 14 illustrates an assembly of a subassembly according to an embodiment of the present invention. Housing 1510 may be formed around a first number of contacts having through-hole contacting portions 1142. Housing 1510 may be formed using injection molding or other appropriate technique. A second number of contacts 1150 may be inserted into openings 1512 in housing 1510. Flanges 1154 may contract during insertion, and then expand once inside openings 1512 to hold the second number of contacts 1150 in place. Once the second number of contacts 1150 are in place, through-hole contacting portions 1142 may be bent in a downward direction, as shown.

Again, using injection molding around the first number of contacts may protect edges of the contacts from being exposed and marring a connector insert during insertion and extraction.

Figure 15:
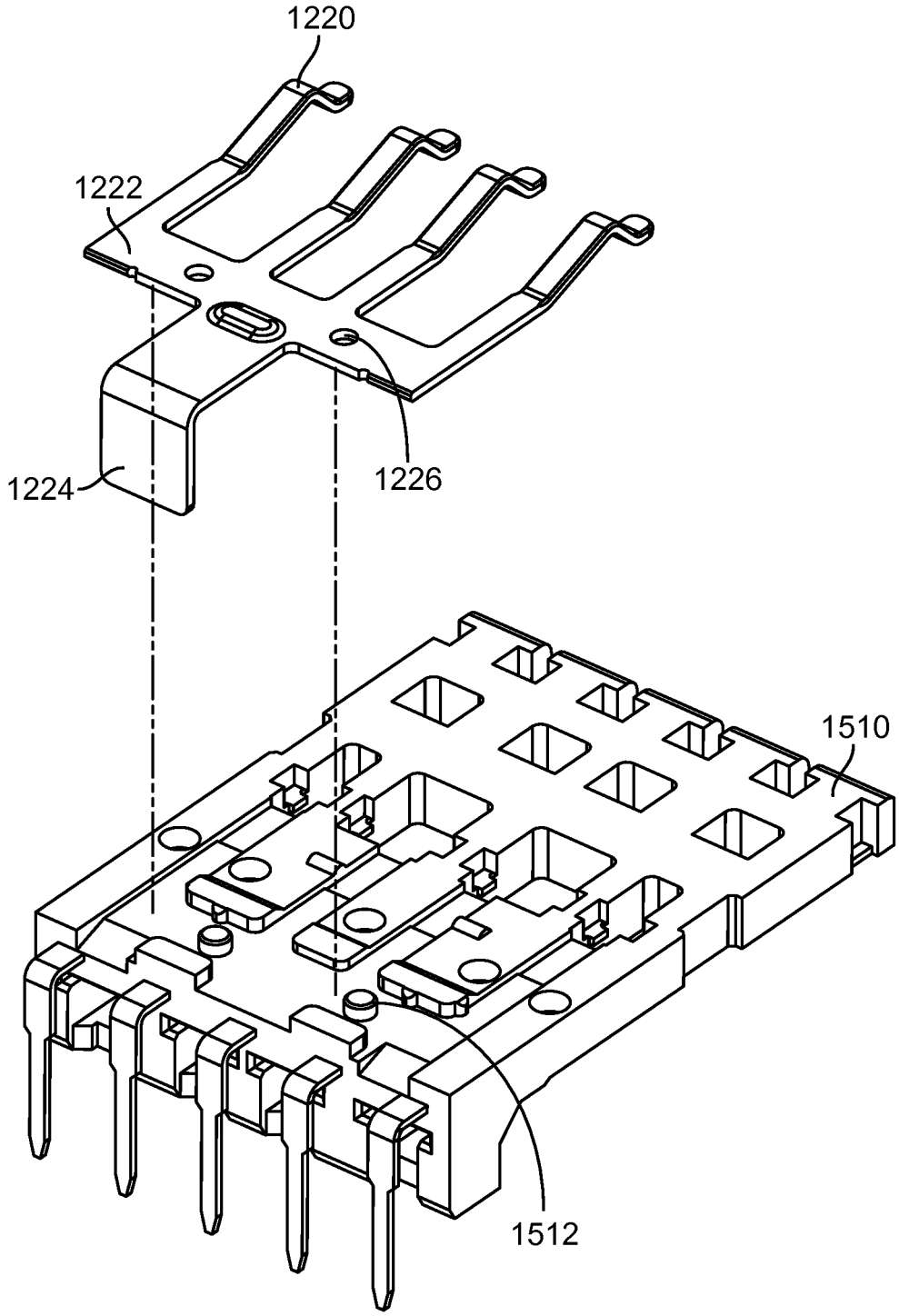
FIG. 15 illustrates an attachment of top contacts to a subassembly according to an embodiment of the present invention.

FIG. 15 illustrates an attachment of top contacts to a subassembly according to an embodiment of the present invention. Specifically, top contacts 1220 may be provided. Top contacts 1220 may be joined by crosspiece 1222, which may be attached to bent portion 1224. Crosspiece 1222 may include openings 1226. Openings 1226 may be arranged to accept posts 1512 on housing 1510.

Figure 16:
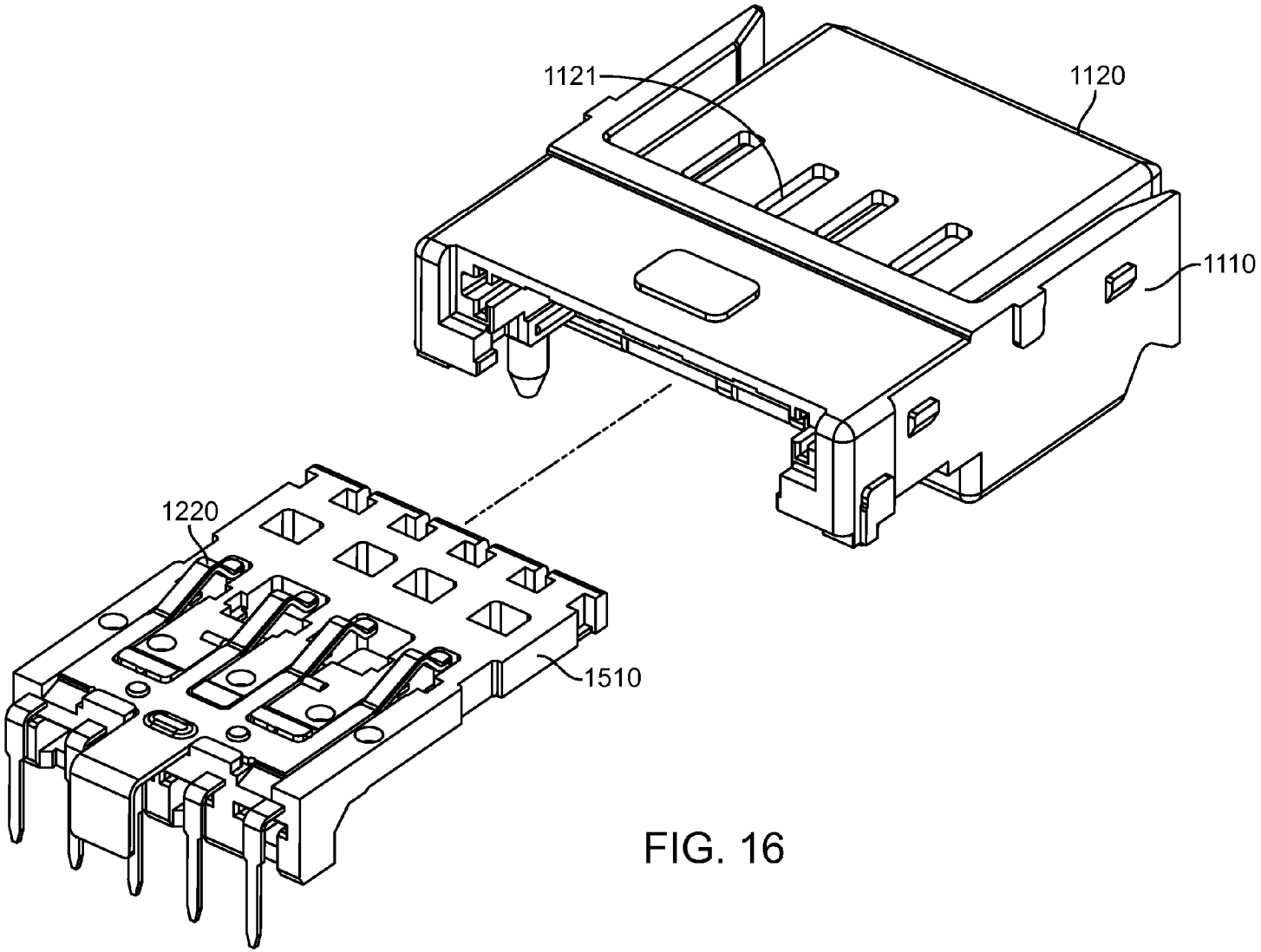
FIG. 16 illustrates the insertion of a subassembly into a tongue of a connector receptacle according to an embodiment of the present invention.

FIG. 16 illustrates the insertion of a subassembly into a tongue of a connector receptacle according to an embodiment of the present invention. Specifically, subassembly housing 1510 and top side contacts 1220 may be inserted into tongue 1120 of housing 1110. Contacts 1220 may be aligned to fit in openings 1121 in tongue 1120.

Figure 17:
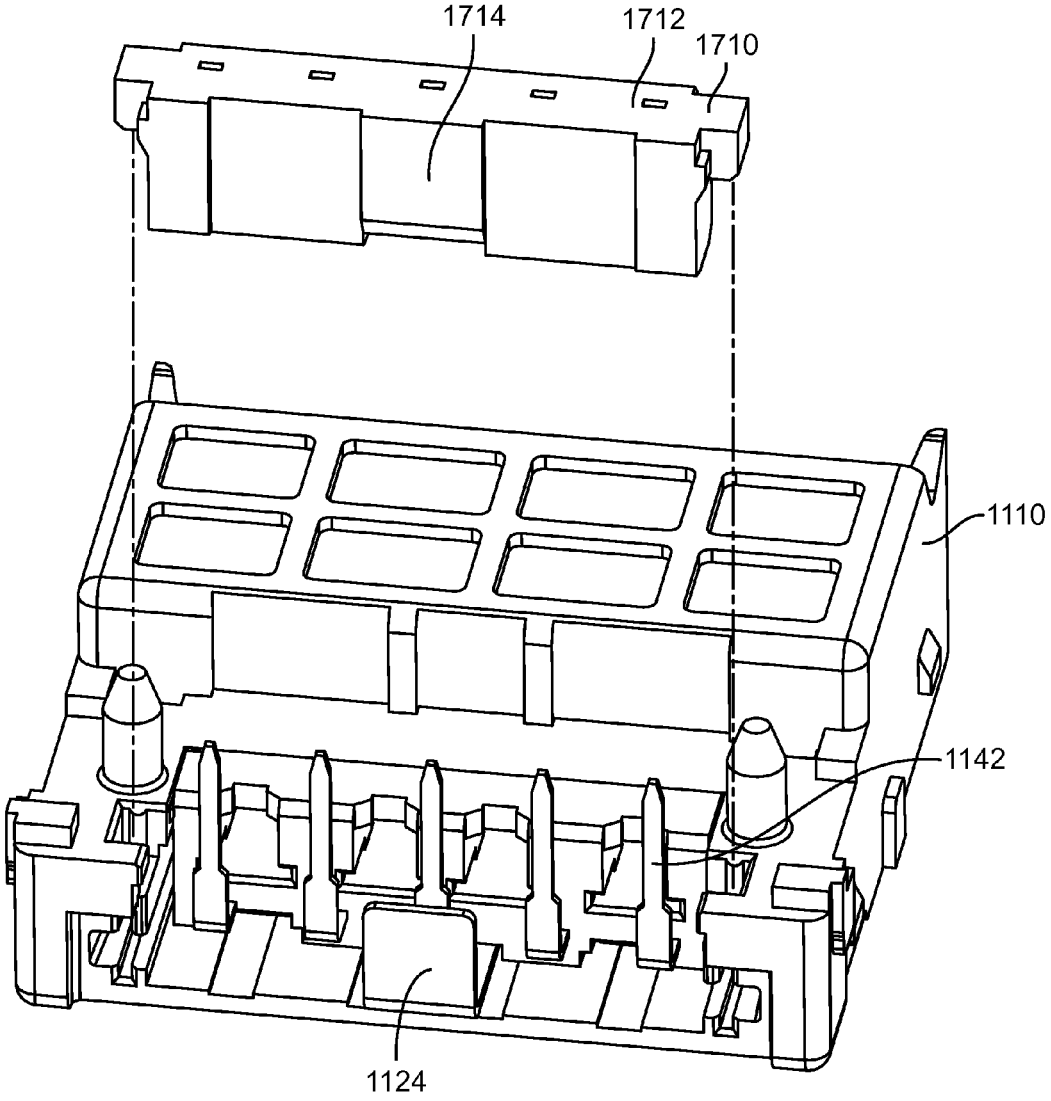
FIG. 17 illustrates the attachment of a through-hole guide piece to a connector receptacle portion according to an embodiment of the present invention.

FIG. 17 illustrates the attachment of a through-hole guide piece to a connector receptacle portion according to an embodiment of the present invention. Specifically, through-hole guide piece 1710 may include openings 1712 for accepting through-hole contacting portions 1142. Through-hole guide piece 1710 may further include notch 1714 for aligning to and mating with bent portion 1124.

Figure 18:
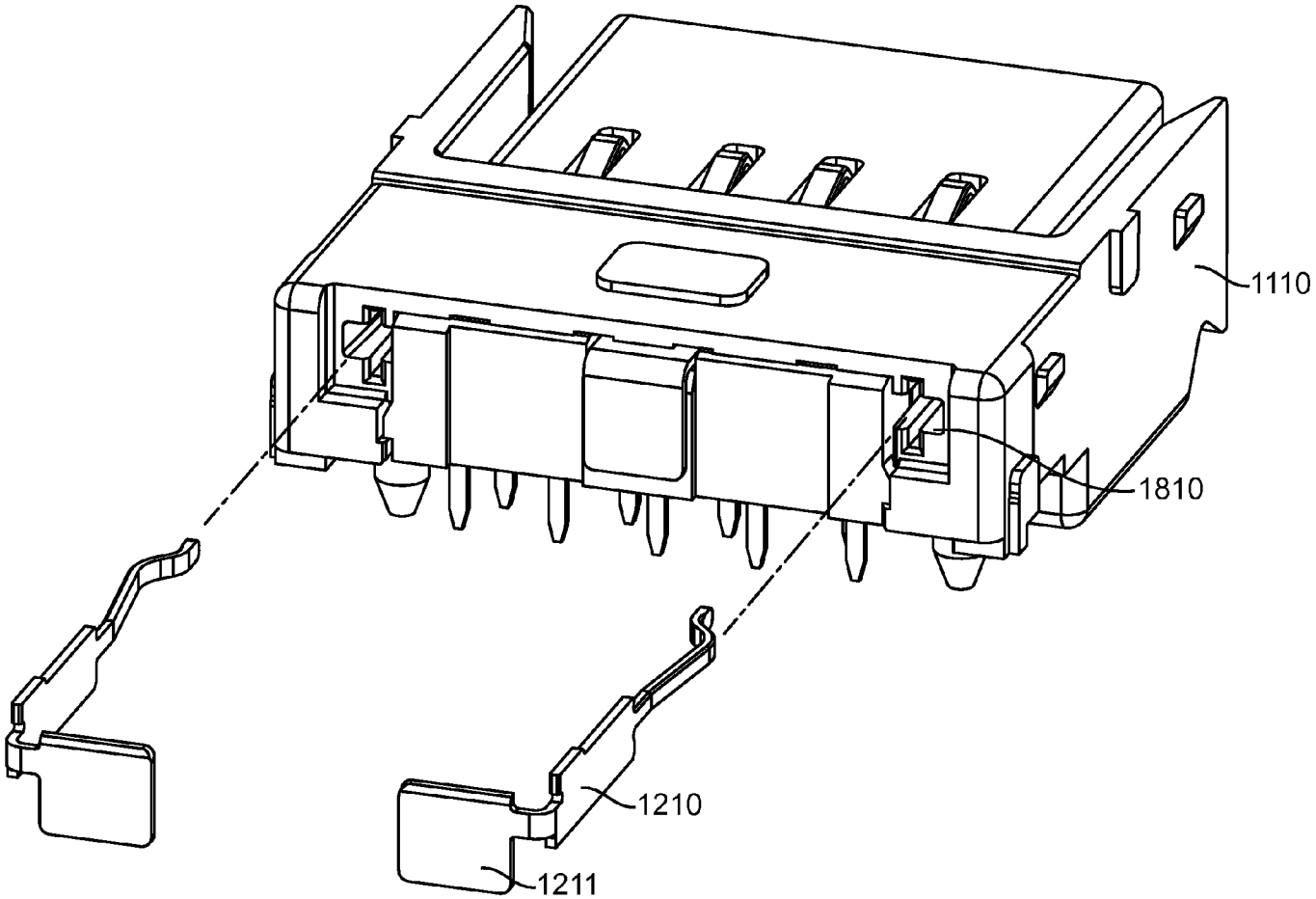
FIG. 18 illustrates the insertion of side ground contacts into a hollow tongue of a connector receptacle according to an embodiment of the present invention.

FIG. 18 illustrates the insertion of side ground contacts into a hollow tongue of a connector receptacle according to an embodiment of the present invention. Specifically, side ground contacts 1210 may be inserted into openings 1810 in housing 1110. Tabs 1211 may align with a back portion of housing 1110.

Figure 19:
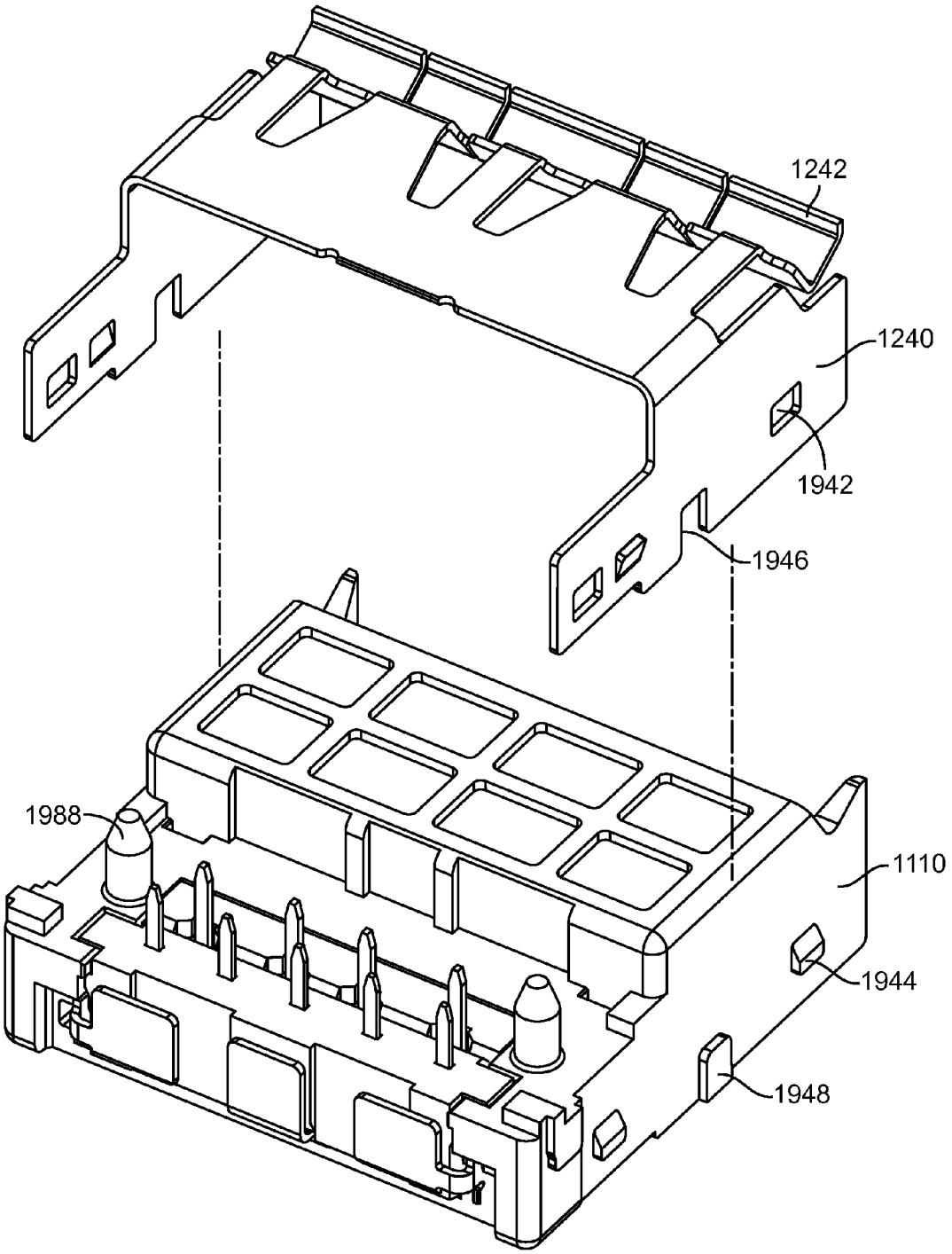
FIG. 19 illustrates the attachment of a shell to a connector receptacle portion according to an embodiment of the present invention.

FIG. 19 illustrates the attachment of a shell to a connector receptacle portion according to an embodiment of the present invention. Specifically, shell 1240 may be attached to housing 1110. Opening 1942 on shell 1240 may align with protrusion 1944 on housing 1110, while notch 1946 on shell 1240 may align with protrusion 1948 on housing 1110. Posts 1988 may be inserted into corresponding openings in a main-logic board or other appropriate substrate for mechanical stability.

Figure 20:
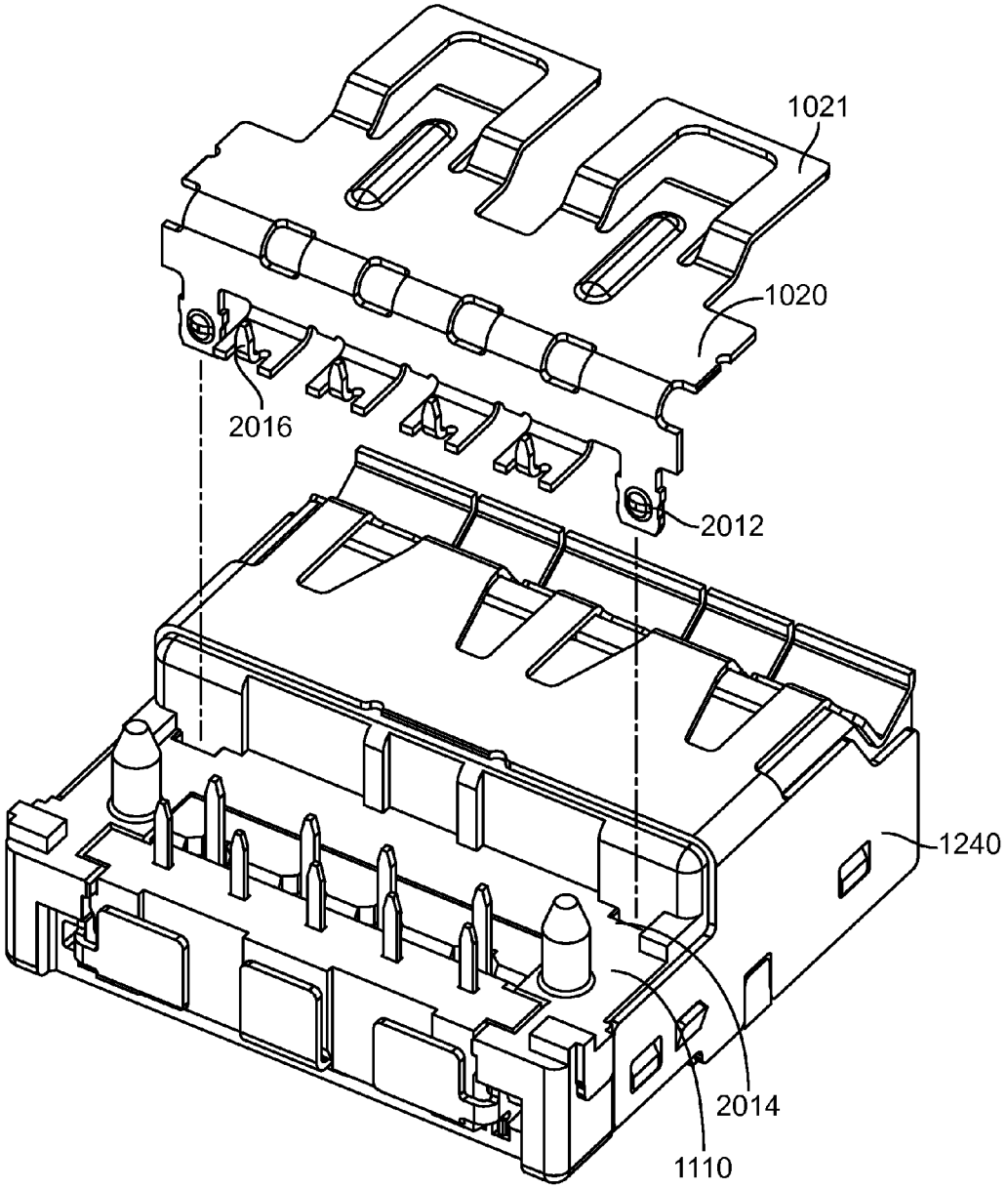
FIG. 20 illustrates an attachment of a bottom piece to a connector receptacle portion according to an embodiment of the present invention.

FIG. 20 illustrates an attachment of a bottom piece to a connector receptacle portion according to an embodiment of the present invention. Specifically, tabs 2012 on bottom piece 1020 may fit in openings 2014 of housing 1110. Bottom piece 1020 may include tabs 2016. Tabs 2016 may be connected to ground of a flexible circuit board, printed circuit board, or other appropriate substrate. Bottom piece 1020 may further include bottom piece contacts 1021. Top piece 1250 may be spot or laser welded, or otherwise fixed to, shell 1240 and tabs 1211.

Figure 21:
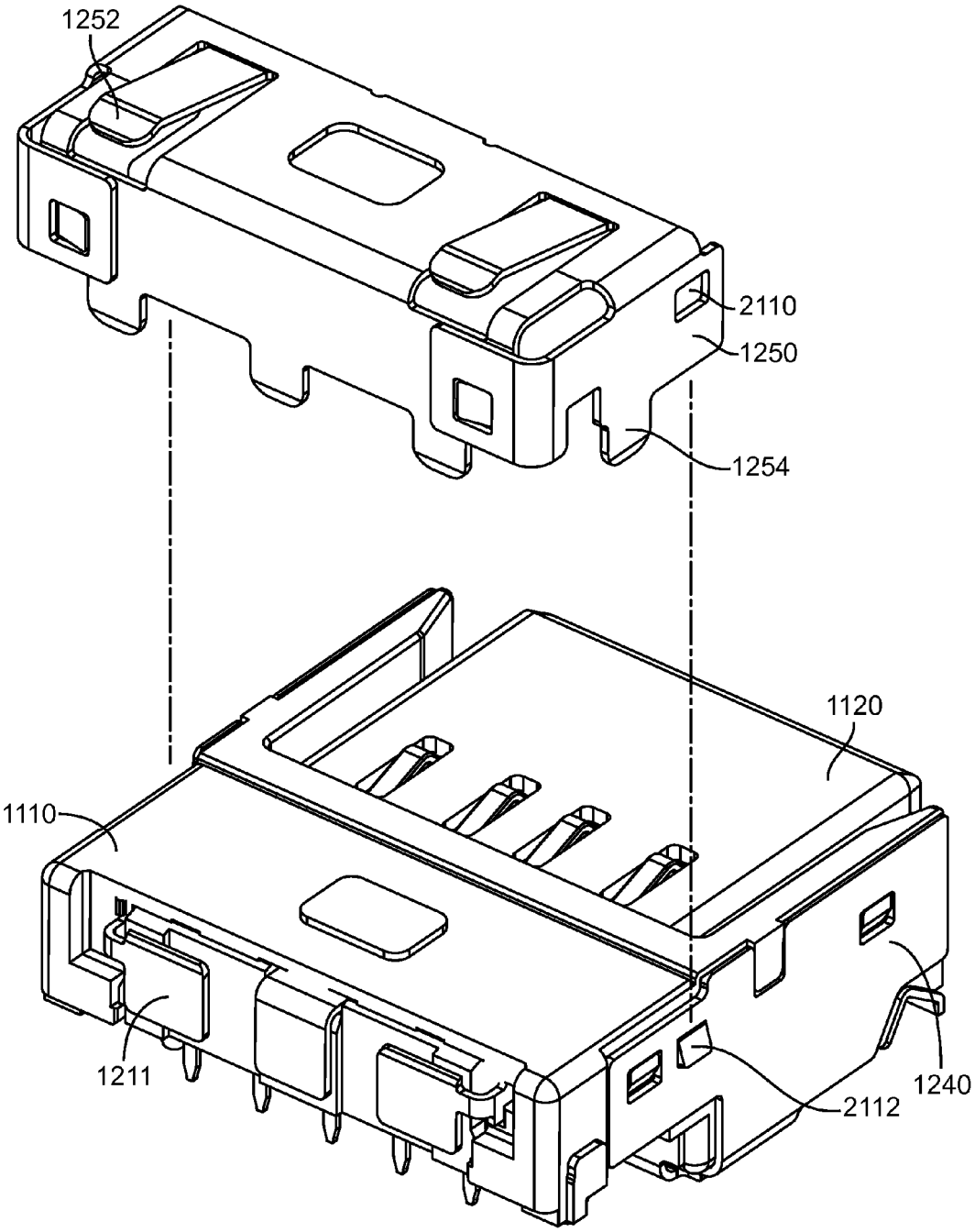
FIG. 21 illustrates an attachment of a top piece to a connector receptacle portion according to an embodiment of the present invention.

FIG. 21 illustrates an attachment of a top piece to a connector receptacle portion according to an embodiment of the present invention. Openings 2110 in top piece 1250 may align with protrusions 2112 on housing 1240. Fingers 1252 may contact a device enclosure or other structure associated with a device enclosure. In other embodiments, Finger 1252 may contact other structures that may or may not be associated with or connected to the device enclosure. Tabs 1254 may be connected to a ground on a flexible circuit board, printed circuit board, or other appropriate substrate.

Figure 22:
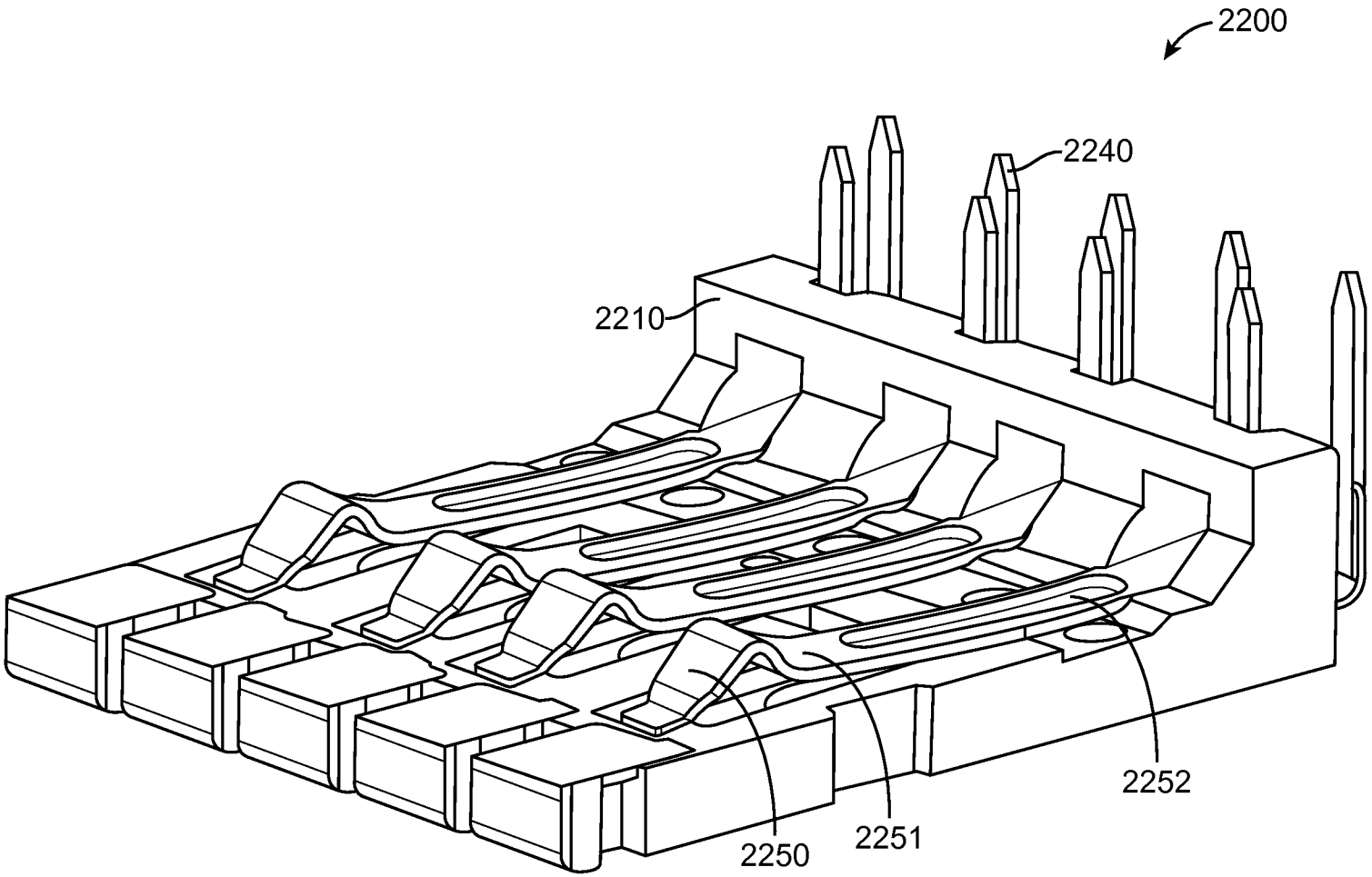
FIG. 22 illustrates another subassembly according to an embodiment of the present invention.

FIG. 22 illustrates another subassembly according to an embodiment of the present invention. Subassembly 2200 may be used as subassembly 1200 in FIG. 12, or as other subassemblies in other embodiments of the present invention. This subassembly may include housing 2210. Housing 2210 may provide support for a first number of contacts 2240, and a second number of contacts 2250. Contacts 2250 may have an added bend just behind the point of electrical contact at 2251. Contacts 2250 may further include a stiffening gusset 2252 down the primary axis. The bend at point 2251 and stiffening gusset 2252 may aid in the connection to USB inserts where contact pads are flush with plastic or other material that is supporting the contacts.

Bottom piece contacts 1021 may rest on a frame, device enclosure, main-logic board, or other appropriate substrate. Ground contacts 1242 may contact a shield or shell 2399 of a connector insert 2398. Noise may be present on this shield or shell 2399, either from noise on the ground line itself, or from signals on conductors in the connector insert 2398. For example, noisy signals may be conveyed over a cable connected to the connector insert 2398. This noise may couple to the shell or shield 2399 of the connector insert 2398. This noise may then couple to ground contact 1242.

Since bottom piece contacts 1021 may be directly connected to ground contacts 1242, noise on ground contacts 1242 may couple to the device enclosure. This noise may then couple to other circuits housed in the device enclosure. Accordingly, in various embodiments of the present invention, bottom piece contacts 1021 may be insulated to keep noise at ground contacts 1242 from coupling onto the device enclosure. An example is shown in the following figure.

Figure 23:
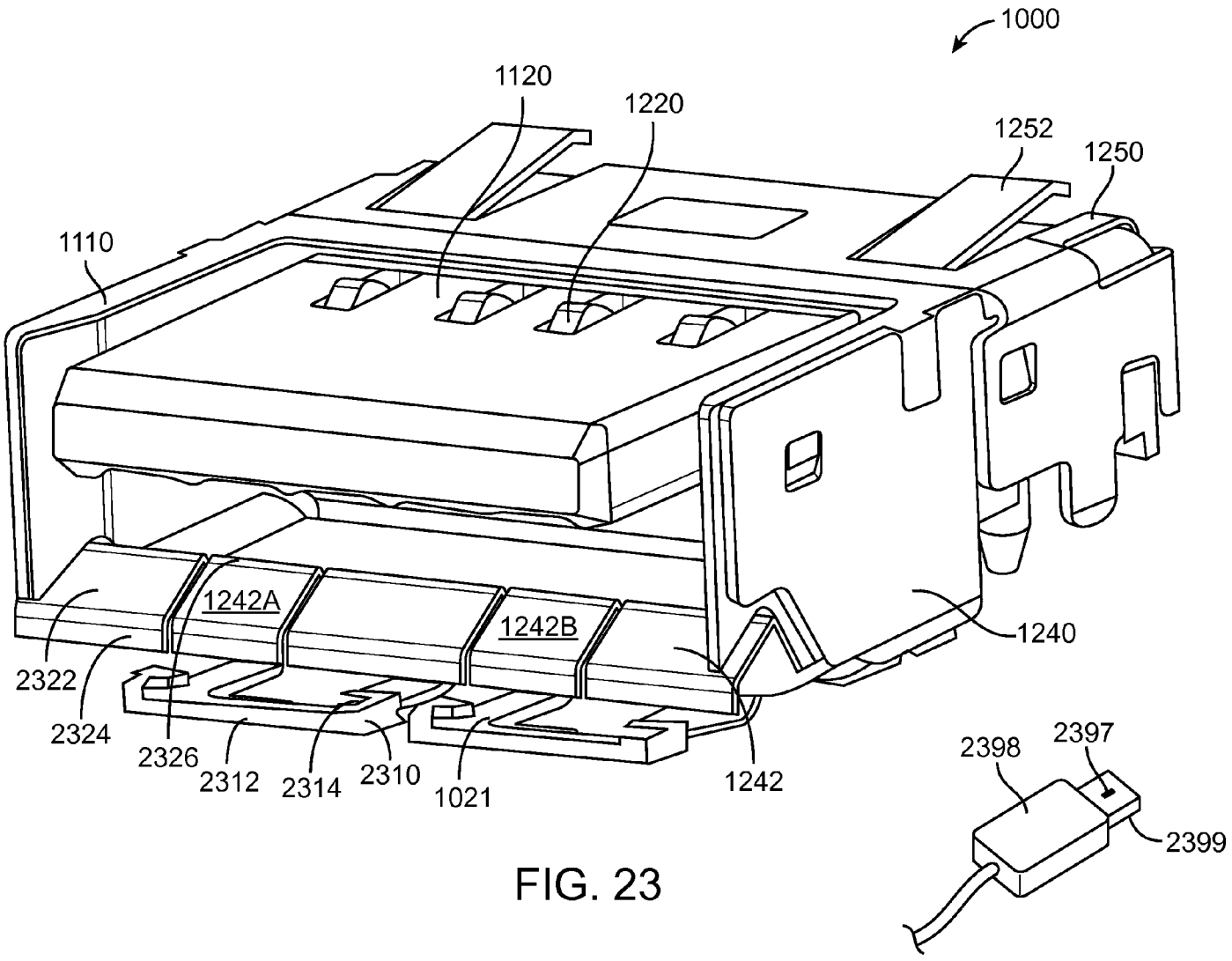
FIG. 23 illustrates a connector receptacle having one or more insulating pieces to electrically isolate a connector receptacle ground from a device enclosure according to an embodiment of the present invention.

FIG. 23 illustrates a connector receptacle having one or more insulating pieces to electrically isolate a connector receptacle ground from a device enclosure according to an embodiment of the present invention. As before, connector receptacle 1000 may include housing 1110, tongue 1120, topside ground contacts 1220, shell 1240, and top piece 1250.

Connector receptacle 1000 may further include ground contact 1242 and bottom piece contacts 1021. Again, without more, noise on a connector insert may couple to ground contact 1242, to bottom piece contacts 1021, to the device enclosure. Noise on the device enclosure may then couple to other circuits in the device enclosure. For example, this noise may couple to an antenna for a wireless transceiver, or other electronic circuitry.

Accordingly, connector receptacle 1000 may further include insulators 2310. Insulators 2310 may include cross piece 2312 and end pieces 2314 that fit over ends or corners of bottom piece ground contacts 1021. These pieces may be made of a nonconductive material, such as rubber, nylon, plastic, or liquid crystal polymers (LCPs) that effectively increase the impedance between bottom piece contacts 1021 and the device enclosure.

Again, connector receptacle 1000 may include ground contacts 1242. Ground contacts 1242 may be used in place of ground contacts such as dimpled ground contacts or bottom ground contacts 230 in FIG. 2. Specifically, ground contacts, such as dimpled contacts or bottom ground contacts 230 in FIG. 2, may be arranged to fit in a pocket 2397 in a shield 2399 of a connector insert 2398. This arrangement may provide a retention force for the connector insert. However, a bottom ground contact 230 may lose contact with a shield 2399 of the connector insert 2398, for example, if it resides in a center of the pocket on the shield of the connector insert 2398. This loss of a ground connection may lead to an increase in ground noise, with a resulting interference with proper signal transmission through the connector. Moreover, bottom ground contact 230 may provide a sharp point. This sharp point may mar or cut a groove in the plug or connector insert 2398 over time. Also, bottom ground contact 230 may provide only a single contact point to ground between connector receptacle 1000 and connector insert 2398.

Accordingly, embodiments of the present invention may employ ground contacts 1242. Ground contacts 1242 may be split into different numbers of contact portions. In this example, ground contact 1242 is split into five sections. By splitting ground contact 1242 in this way, several points along ground contact 1242 may make contact with a shield of a connector insert. Also, ground contact portions 1242A and 1242B may be arranged to fit in openings or pockets in the connector insert shield, thereby providing a retention force. The sections of ground contact 1242 may be split by very fine separations to provide an attractive appearance for the connector receptacle. Ground contact 1242 may provide a smoother edge for a connector insert in order to help avoid marring of the connector insert. Ground contact 1242 may be connected to a first shell portion or ground feature 1240.

Ground contact 1242 may be located under tongue 1120. Ground contact 1242 may have a front sloping portion 2322, where the front sloping portion 2322 slopes from a front bottom of the connector receptacle 1000 upwards to a back of the connector receptacle 1000. The front sloping portion 2322 may form a ridge 2326 that may contact a shield of a connector insert when the connector insert is inserted into connector receptacle 1000. The front sloping portion 2324 may have a downward, tapered bottom edge 2324. This downward, tapered bottom edge 2324 may help to prevent the ground contact 1242 from becoming snagged and damaged when the connector insert is inserted into connector receptacle 1000.

Figure 24:
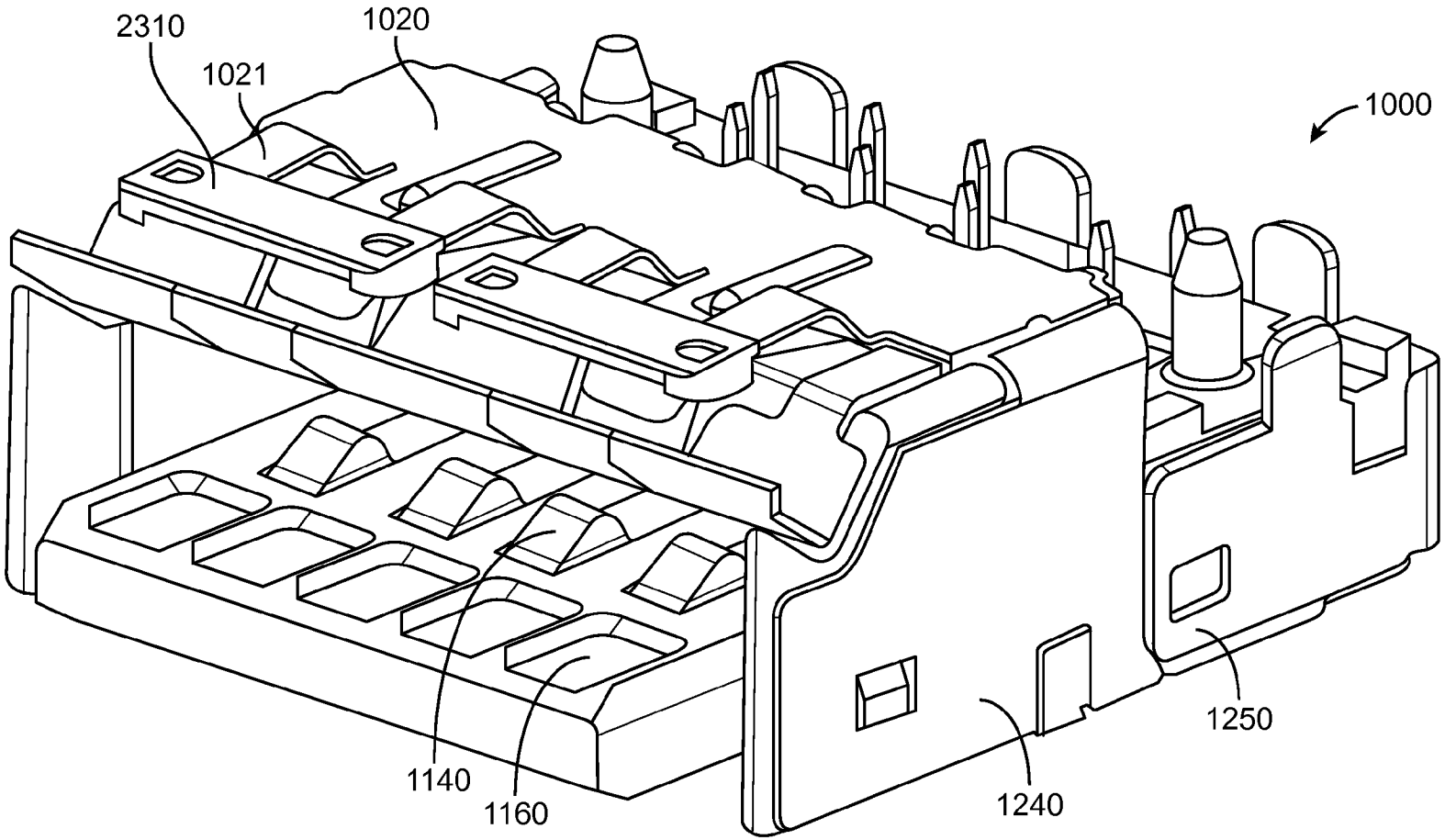
FIG. 24 illustrates another view of a connector receptacle having one or more insulating pieces to electrically isolate a connector receptacle ground from a device enclosure according to an embodiment of the present invention.

FIG. 24 illustrates another connector receptacle having one or more insulating pieces to electrically isolate a connector receptacle ground from a device enclosure according to an embodiment of the present invention. Again, connector receptacle 1000 includes a shell 1240, top piece 1250, and contacts 1140 and 1160. Bottom ground pieces 1021 may connect to shell 1240 via bottom piece 1020. Insulator 2310 may electrically isolate grounds of connector receptacle 1000 from a device enclosure housing connector receptacle 1000.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector receptacle comprising:

a housing having a tongue;

a plurality of contacts residing on the tongue;

a first shell portion at least partially surrounding a bottom of the housing;

a ground contact formed from a front portion of the first shell portion and located under the tongue, the ground contact having a width greater than the width of the tongue, the ground contact having a front sloping portion, the front sloping portion sloping from a front bottom of the connector receptacle upwards to a back of the connector receptacle, the front sloping portion terminating at a ridge; and a first bottom piece contact formed separately from the first shell portion and attached to the front shell portion and under the ground contact and first shell portion.

2. The connector receptacle of claim 1 wherein the ridge may contact a shell of a connector insert when the connector insert is inserted into connector receptacle.

3. The connector receptacle of claim 1 wherein the ground contact is split into multiple portions.

4. The connector receptacle of claim 1 wherein the ground contact is split into multiple portions.

5. The connector receptacle of claim 1 further comprising a second bottom ground contact under the connector receptacle.

6. The connector receptacle of claim 5 further comprising a first insulator under a bottom of the first bottom ground contact and a second insulator under a bottom of the second bottom ground contact.

7. The connector receptacle of claim 1 wherein the front sloping portion is substantially flat.

8. The connector receptacle of claim 7 wherein the ground contact further comprises a front piece providing a flat surface parallel to a front opening of the connector receptacle and a back sloping portion from the ridge to the remainder of the first shell.

9. The connector receptacle of claim 1 wherein the ground contact is split into three portions, and wherein a center portion may be arranged to fit in a pocket in a shell of a connector insert when the connector insert is inserted into connector receptacle.

10. The connector receptacle of claim 9 wherein the front sloping portion may have a downward-tapered bottom edge.

11. The connector receptacle of claim 9 wherein separations between the three portions of the ground contact are narrow compared to the width of each of the three portions of the ground contact.

12. A connector receptacle comprising:

a housing having a tongue;

a plurality of contacts residing on the tongue;

a first shell portion at least partially surrounding a bottom of the housing; and a ground contact formed from a front portion of the first shell portion and located under the tongue, the ground contact having a width greater than the width of the tongue, the ground contact having a front sloping portion, the front sloping portion sloping from a front bottom of the connector receptacle upwards to a back of the connector receptacle, the front sloping portion terminating at a ridge, and a back sloping portion sloping from the ridge to the remainder of the first shell.

13. The connector receptacle of claim 12 further comprising a first bottom piece contact formed separately from the first shell portion and attached to the front shell portion and under the ground contact and first shell portion.

14. The connector receptacle of claim 12 wherein the ridge may contact a shell of a connector insert when the connector insert is inserted into connector receptacle.

15. The connector receptacle of claim 12 wherein the ground contact is split into multiple portions.

16. The connector receptacle of claim 12 wherein the ground contact is split into three portions, and wherein a center portion may be arranged to fit in a pocket in a shell of a connector insert when the connector insert is inserted into connector receptacle.

17. The connector receptacle of claim 12 wherein the front sloping portion may have a downward-tapered bottom edge.

18. The connector receptacle of claim 12 wherein the housing includes a front opening and the ground contact extends at least substantially across a bottom the front opening.

19. The connector receptacle of claim 12 wherein the front sloping portion is substantially flat.

20. The connector receptacle of claim 19 wherein the ground contact further comprises a front piece providing a flat surface parallel to a front opening of the connector receptacle.

21. A connector receptacle comprising:

a connector receptacle housing, the connector receptacle housing having a tongue, the tongue being substantially hollow;

a subassembly located in the hollow tongue, the subassembly comprising:

a first plurality of contacts;

an insert molded housing around at least a portion of the first plurality of contacts; and a second plurality of contacts attached to the insert molded housing;

a first side ground contact aligned with a first side opening on a first side of the tongue;

a second side ground contact aligned with a second side opening on a second side of the tongue, a first shell portion at least partially surrounding a bottom of the housing; and a ground contact formed from a front portion of the first shell portion and located under the tongue, the ground contact having a width greater than the width of the tongue, the ground contact having a front sloping portion, the front sloping portion sloping from a front bottom of the connector receptacle upwards to a back of the connector receptacle, the front sloping portion terminating at a ridge, and a back sloping portion sloping from the ridge to the remainder of the first shell.

22. The connector receptacle of claim 21 wherein the subassembly is formed as a single structure inserted in the hollow tongue.

23. The connector receptacle of claim 21 wherein the second plurality of contacts are each inserted into a separate opening in the insert molded housing.

24. The connector receptacle of claim 21 wherein the first and second ground contacts are formed separately.

25. The connector receptacle of claim 21 wherein the housing includes a front opening and the ground contact extends at least substantially across a bottom the front opening.

26. The connector receptacle of claim 21 further comprising a first bottom piece contact formed separately from the first shell portion and attached to the front shell portion and under the ground contact and first shell portion.

27. The connector receptacle of claim 26 wherein the ground contact further comprises a front piece providing a flat surface parallel to a front opening of the connector receptacle.

28. The connector receptacle of claim 21 wherein the tongue comprises a first plurality of openings on a bottom side of the tongue to provide access to the first plurality of contacts and a second plurality of openings on a bottom side of the tongue to provide access to the second plurality of contacts.

29. The connector receptacle of claim 28 wherein the first plurality of openings are between the second plurality of openings and a front of the tongue.

30. The connector receptacle of claim 29 wherein the first plurality of openings are arranged such that edges of the first plurality of contacts are not exposed.

31. The connector receptacle of claim 29 wherein the first plurality of openings are arranged such that edges of the first plurality of contacts are covered by the tongue.

32. The connector receptacle of claim 29 further comprising:

a third ground contact aligned with a first top opening on a top of the tongue; and a fourth ground contact aligned with a second top opening on the top of the tongue.

33. The connector receptacle of claim 29 wherein the connector receptacle is a Universal Serial Bus 3 compatible connector receptacle.

34. The connector receptacle of claim 29 further comprising a shell, the shell around a bottom and sides of the connector receptacle.

35. The connector receptacle of claim 34 wherein the shell is substantially absent from a top of the connector receptacle.

36. The connector receptacle of claim 34 further comprising a top piece, the top piece covering a back top portion of the connector receptacle.

* * * * *